US012246801B2

(12) United States Patent
Prescott

(10) Patent No.: US 12,246,801 B2
(45) Date of Patent: Mar. 11, 2025

(54) SEAT FOR WATERCRAFT

(71) Applicant: David Prescott, Albany, NY (US)

(72) Inventor: David Prescott, Albany, NY (US)

( * ) Notice: Subject to any disclaimer, the term of this patent is extended or adjusted under 35 U.S.C. 154(b) by 464 days.

(21) Appl. No.: 17/462,122

(22) Filed: Aug. 31, 2021

(65) Prior Publication Data

US 2023/0068542 A1 Mar. 2, 2023

(51) Int. Cl.
*B63B 29/04* (2006.01)
*B63B 29/02* (2006.01)

(52) U.S. Cl.
CPC ..... *B63B 29/04* (2013.01); *B63B 2029/022* (2013.01); *B63B 2029/043* (2013.01); *B63B 2029/046* (2013.01)

(58) Field of Classification Search
CPC ..... B63B 29/04; B63B 2029/043
See application file for complete search history.

(56) References Cited

U.S. PATENT DOCUMENTS

| | | | | |
|---|---|---|---|---|
| 3,587,123 | A | 6/1971 | O'Boyle | |
| 4,462,485 | A | 7/1984 | Terry et al. | |
| 4,538,314 | A | 9/1985 | Baranowski | |
| 4,720,280 | A * | 1/1988 | Hufnagl | B63B 32/66 441/74 |
| 4,722,419 | A | 2/1988 | Hoszowski | |
| 5,025,747 | A | 6/1991 | Grayson | |
| 5,249,998 | A * | 10/1993 | Woolley | B63B 34/40 114/274 |
| 7,900,575 | B2 * | 3/2011 | Walbridge | B63B 29/04 114/363 |
| 9,475,554 | B2 | 10/2016 | Heimerl | |
| 10,124,859 | B2 | 11/2018 | Burnett et al. | |
| 10,336,411 | B2 | 7/2019 | Curts et al. | |
| 10,399,645 | B1 | 9/2019 | Holmes | |
| 10,703,446 | B2 | 7/2020 | Riccardi et al. | |
| 2011/0023770 | A1 * | 2/2011 | Brown | B63B 27/143 114/362 |
| 2019/0125085 | A1 * | 5/2019 | O'Neal | B60N 3/10 |
| 2021/0047005 | A1 | 2/2021 | Fafard et al. | |

FOREIGN PATENT DOCUMENTS

| | | | | |
|---|---|---|---|---|
| EP | 3988425 | A1 * | 4/2022 | B62B 5/069 |
| JP | 2002321684 | A * | 11/2002 | |

* cited by examiner

*Primary Examiner* — Milton Nelson, Jr.

(57) ABSTRACT

Disclosed embodiments provide an apparatus having a submersible seating surface attached to a watercraft. The submersible seating surface may be raised to serve as a table when not in use as a seat. A tension member provides upward force on the seat, allowing it to be easily raised from a lowered position to a raised position. In some embodiments, a tether is used to provide additional security for the apparatus. In embodiments, a hydrofoil cup holder is affixed to the seat to provide additional lift when a watercraft is moving forward, urging the seat upward and out of the water. The hydrofoil cup holder further includes an opening in a top surface of the cup holder to secure an item such as a beverage container. Embodiments may further include a submerged safety indicator to alert nearby swimmers and/or people on the watercraft of the submerged seat.

10 Claims, 29 Drawing Sheets

SEAT FOR WATERCRAFT

FIELD

The present invention relates generally to watercraft, and more particularly, to a seat for watercraft.

BACKGROUND

Watercraft, such as boats and other personal watercraft such as jet skis are used for many recreational activities. These can include sailing, fishing, swimming, and other activities. These activities can take place in rivers, lakes, bays, or the ocean.

SUMMARY

In some embodiments, there is provided an apparatus comprising: a mounting spar; a first intermediate spar rotatably connected to the mounting spar at a first end of the first intermediate spar; a seat bracket, the seat bracket rotatably connected to a second end of the first intermediate spar; and a seat, the seat affixed to the seat bracket.

In some embodiments there is provided an apparatus comprising: a mounting spar; a first intermediate spar rotatably connected to the mounting spar at a first end of the first intermediate spar; a second intermediate spar rotatably connected to the mounting spar at a first end of the second intermediate spar; a seat bracket, the seat bracket rotatably connected to a second end of the first intermediate spar and a second end of the second intermediate spar; a first torque link rotatably connected to the mounting spar at a first end of the first torque link, wherein the first torque link is rotatably connected to the seat bracket at a second end of the first torque link; a second torque link rotatably connected to the mounting spar at a first end of the second torque link, wherein the second torque link is rotatably connected to the seat bracket at a second end of the second torque link; a tension member disposed between the mounting spar and the first and second intermediate spars; a sleeve surrounding the first intermediate spar, second intermediate spar, first torque link, second torque link, and tension member; and a seat, the seat affixed to the seat bracket.

Figure 1:
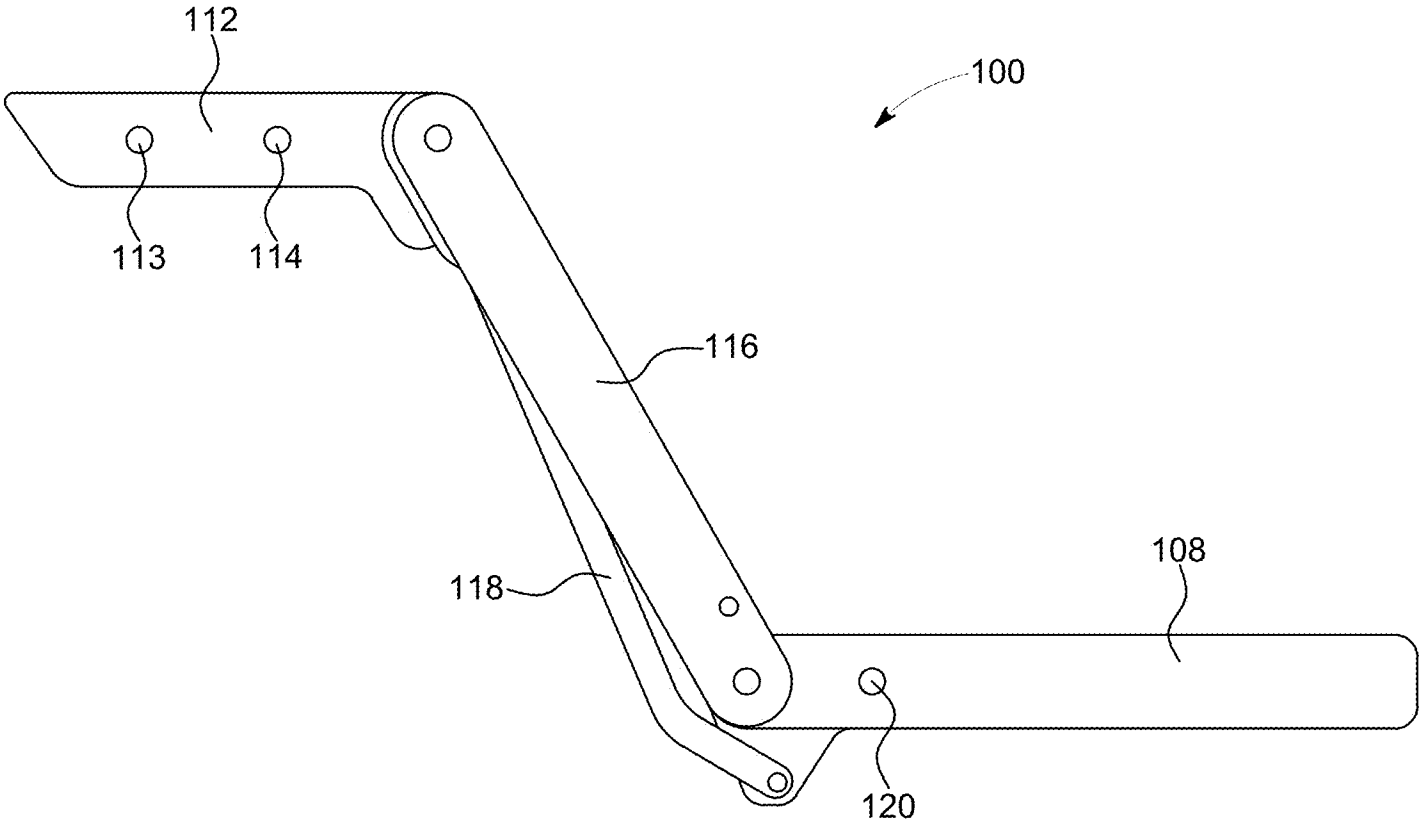
FIG. 1 shows a side view of an assembly in accordance with embodiments of the present invention in a lowered configuration.

The drawings are not necessarily to scale. The drawings are merely representations, not necessarily intended to portray specific parameters of the invention. The drawings are intended to depict only example embodiments of the invention, and therefore should not be considered as limiting in scope. In the drawings, like numbering may represent like elements. Furthermore, certain elements in some of the figures may be omitted, or illustrated not-to-scale, for illustrative clarity.

DETAILED DESCRIPTION

Disclosed embodiments provide a submersible seat for use on a watercraft, such as a boat. The seat is attached to a movable arm mechanism that allows the seat to be moved between a lowered position and a raised position. In embodiments, the movable arm mechanism attaches to a watercraft, such as the stern of a boat. The movable arm mechanism is attached to the watercraft such that the lowered position is below the waterline (or approximate waterline), and can be used as a swim-up seat. Furthermore, the movable arm mechanism is attached to the watercraft such that the raised position is above the waterline (or approximate waterline), and can be used as a table in that configuration. Furthermore, a tension member, such as a hydraulic cylinder is attached to portions of the movable arm mechanism to enable the seat to be easily raised when it is not being used as a seat.

Reference throughout this specification to "one embodiment," "an embodiment," "some embodiments", or similar language means that a particular feature, structure, or characteristic described in connection with the embodiment is included in at least one embodiment of the present invention. Thus, appearances of the phrases "in one embodiment," "in an embodiment," "in some embodiments", and similar language throughout this specification may, but do not necessarily, all refer to the same embodiment.

Moreover, the described features, structures, or characteristics of the invention may be combined ("mixed and matched") in any suitable manner in one or more embodiments. It will be apparent to those skilled in the art that various modifications and variations can be made to the present invention without departing from the spirit and scope and purpose of the invention. Thus, it is intended that the present invention cover the modifications and variations of this invention provided they come within the scope of the appended claims and their equivalents. Reference will now be made in detail to the preferred embodiments of the invention.

The terminology used herein is for the purpose of describing particular embodiments only and is not intended to be limiting of this disclosure. As used herein, the singular forms "a", "an", and "the" are intended to include the plural forms as well, unless the context clearly indicates otherwise. Furthermore, the use of the terms "a", "an", etc., do not denote a limitation of quantity, but rather denote the presence of at least one of the referenced items. The term "set" is intended to mean a quantity of at least one. It will be further understood that the terms "comprises" and/or "comprising", or "includes" and/or "including", or "has" and/or "having", when used in this specification, specify the presence of stated features, regions, integers, steps, operations, elements, and/or components, but do not preclude the presence or addition of one or more other features, regions, and/or elements. For the purposes of disclosure, the word, "substantially" is defined as "for the most part". It means "to a great extent," but having some room for some minor variation.

FIG. 1 shows a side view of an assembly 100 in a lowered configuration, in accordance with embodiments of the present invention. Assembly 100 is a movable arm. Assembly 100 includes a mounting spar 112. The mounting spar 112 is configured and disposed to couple with a receiver tube mounted on a watercraft such as a boat. The mounting spar includes a first mounting spar opening 113 and a second mounting spar opening 114 that can be used to receive a hitch pin to secure the mounting spar 112 to the receiver tube.

The assembly includes an intermediate spar 116. A first end of the intermediate spar 116 is rotatably attached to the mounting spar 112. A second end of the intermediate spar 116 is rotatably attached to seat bracket 108. Seat bracket 108 includes a seat attachment opening 120 that is used to attach a seat to the seat bracket 108.

A torque link 118 is rotatably attached the mounting spar 112 at a first end of the torque link 118. The torque link 118 is rotatably attached to the seat backet 108 at a second end of the torque link 118 (see FIGS. 9A and 9B). In embodiments, the mounting spar 112, seat bracket 108, and torque link 118 may be comprised of a metal such as aluminum, stainless steel, or other suitable material.

Figure 2:
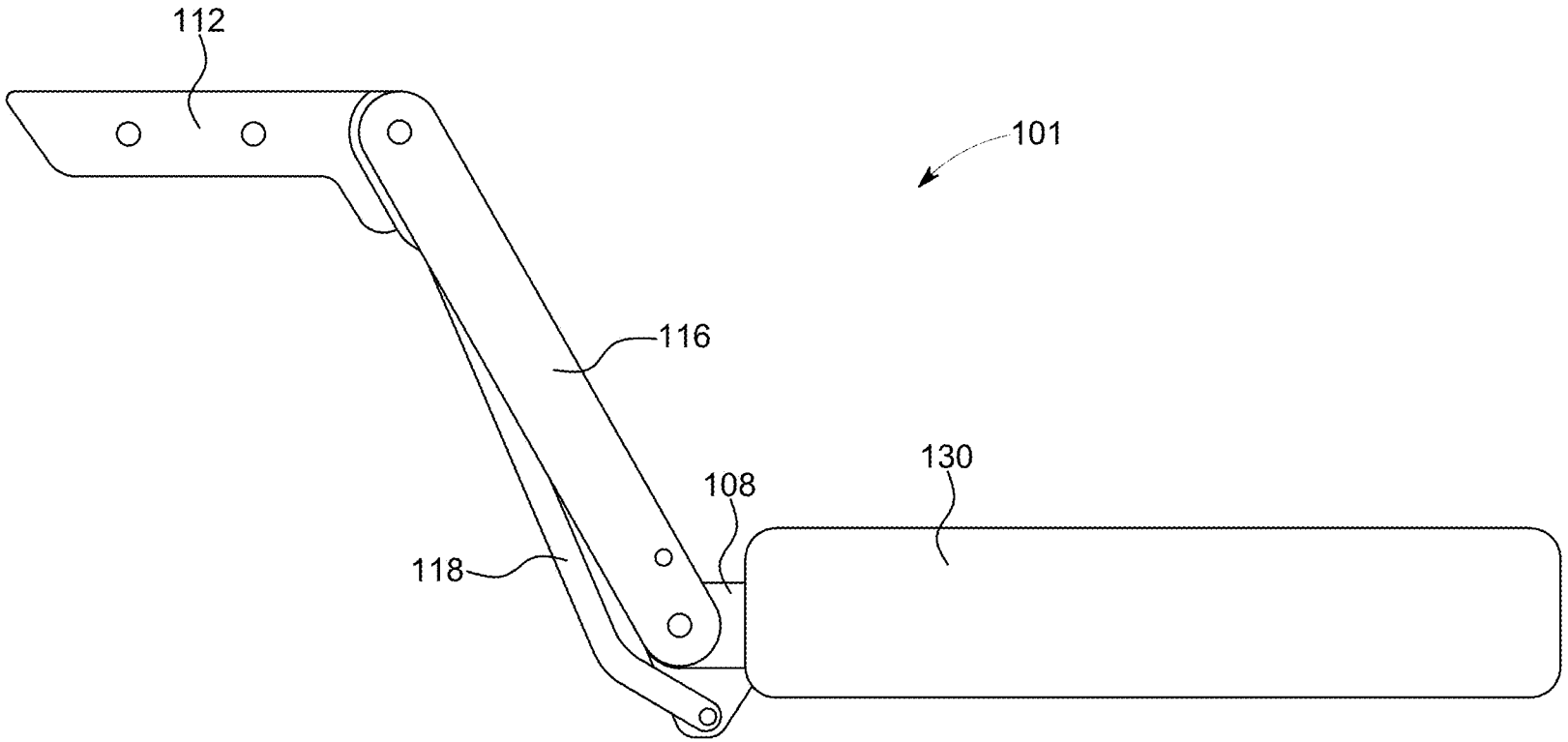
FIG. 2 shows a side view of an assembly including a seat in accordance with embodiments of the present invention in a lowered configuration.

FIG. 2 shows a side view of an assembly 101 (similar to assembly 100) including a seat 130 in accordance with embodiments of the present invention in a lowered configuration. In embodiments, seat 130 may be comprised of a plastic such as polycarbonate or other suitable material.

Figure 3:
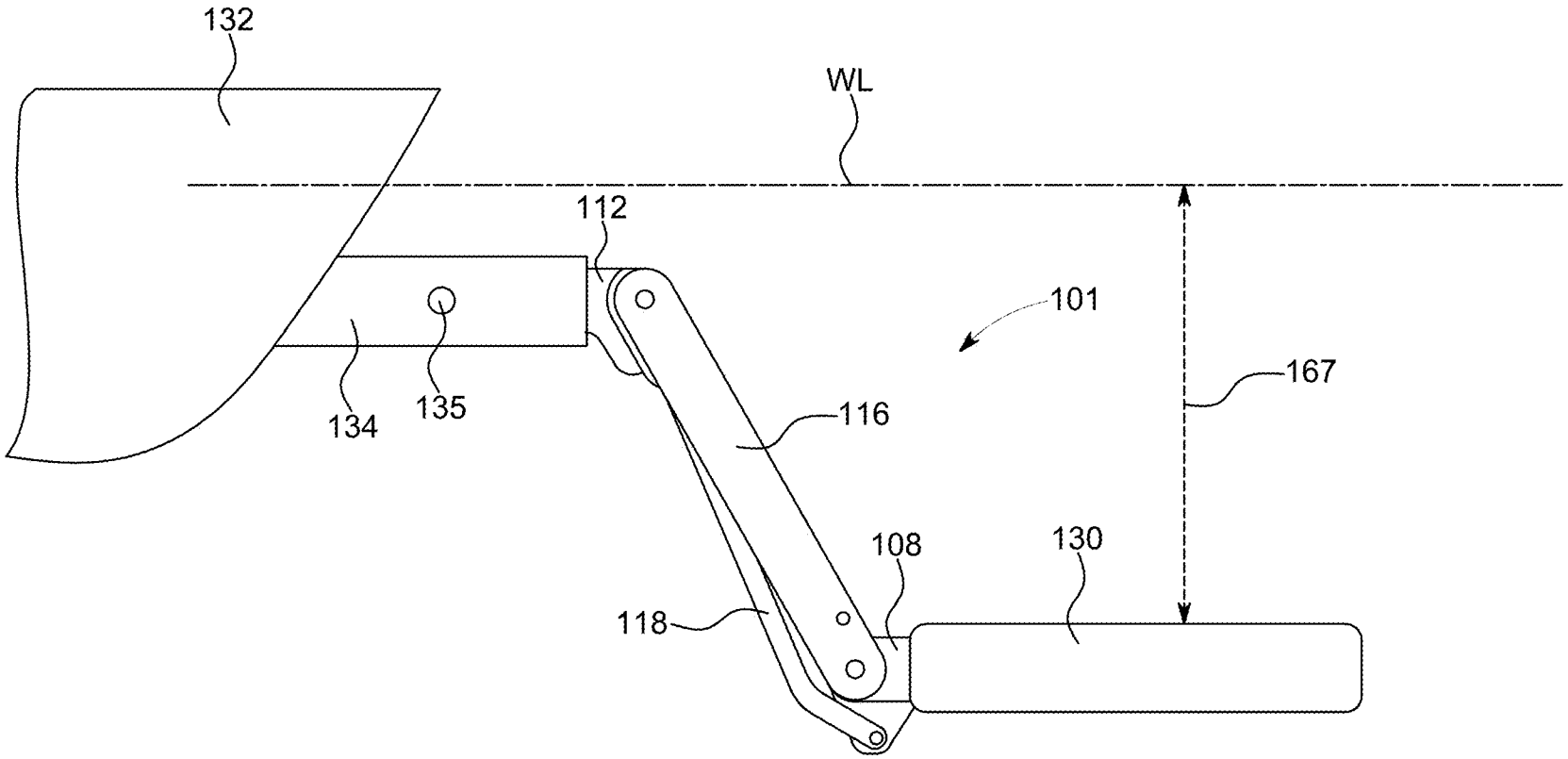
FIG. 3 shows a side view of an assembly including a seat in accordance with embodiments of the present invention in a lowered configuration as installed on a watercraft.

FIG. 3 shows a side view of assembly 101 including seat 130 in accordance with embodiments of the present invention in a lowered configuration as installed on a watercraft 132. In embodiments, watercraft 132 is a boat. FIG. 3 shows a stern portion of watercraft 132 in water, having a water level corresponding to height WL (waterline or approximate waterline). Preferably, the apparatus is installed behind the stern of the watercraft 132. Watercraft 132 includes a receiver tube 134 disposed at the stern of the watercraft 132. The mounting spar 112 is inserted into the receiver tube 134 to secure the assembly 101 to the watercraft 132. The receiver tube 134 may include a side opening 135 to allow insertion of a hitch pin to further secure the assembly 101 to the watercraft 132.

As shown in FIG. 3, the assembly 101 is in a lowered configuration, and the seat 130 is below the water level at height WL. This allows a person swimming in the water to "swim up" to the seat 130 and sit. In the lowered configuration, the seat 130 has a seat depth 167. In embodiments, the seat depth ranges from about 25 centimeters to about 80 centimeters. This allows the lower portion of a user to be submerged, while an upper portion including shoulders and head to be above the water level at height WL.

Figure 4A:
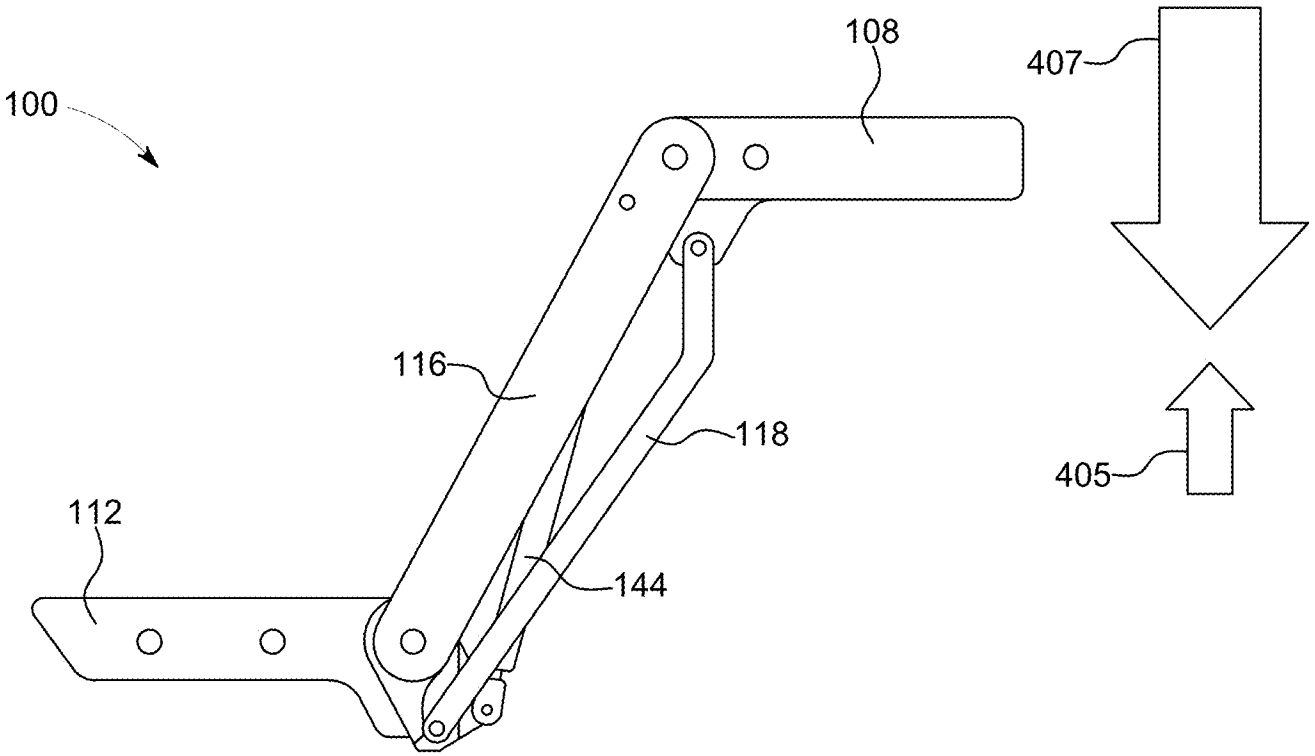
FIG. 4A shows a side view of an assembly in accordance with embodiments of the present invention in a raised configuration.

FIG. 4A shows a side view of assembly 100 in accordance with embodiments of the present invention in a raised configuration. In this configuration, the seat bracket 108 is moved such that it is above the mounting spar 112. As can be seen in FIG. 4A, a tension member, such as hydraulic cylinder 144 may be rotatably attached to the mounting spar 112 and seat bracket 108. The hydraulic cylinder 144 provides an upward force indicated by arrow 405. The upward force, represented as arrow 405, is less than the downward force, represented as arrow 407, typically exerted by a person when sitting on the seat in the water. The upward force 405 is selected such that the assembly 100 may move with little or no manual intervention to the raised configuration when not in use as a seat. To use the apparatus in the lowered position, a user can swim up to the seat and press the seat downward to sit on it.

Figure 4B:
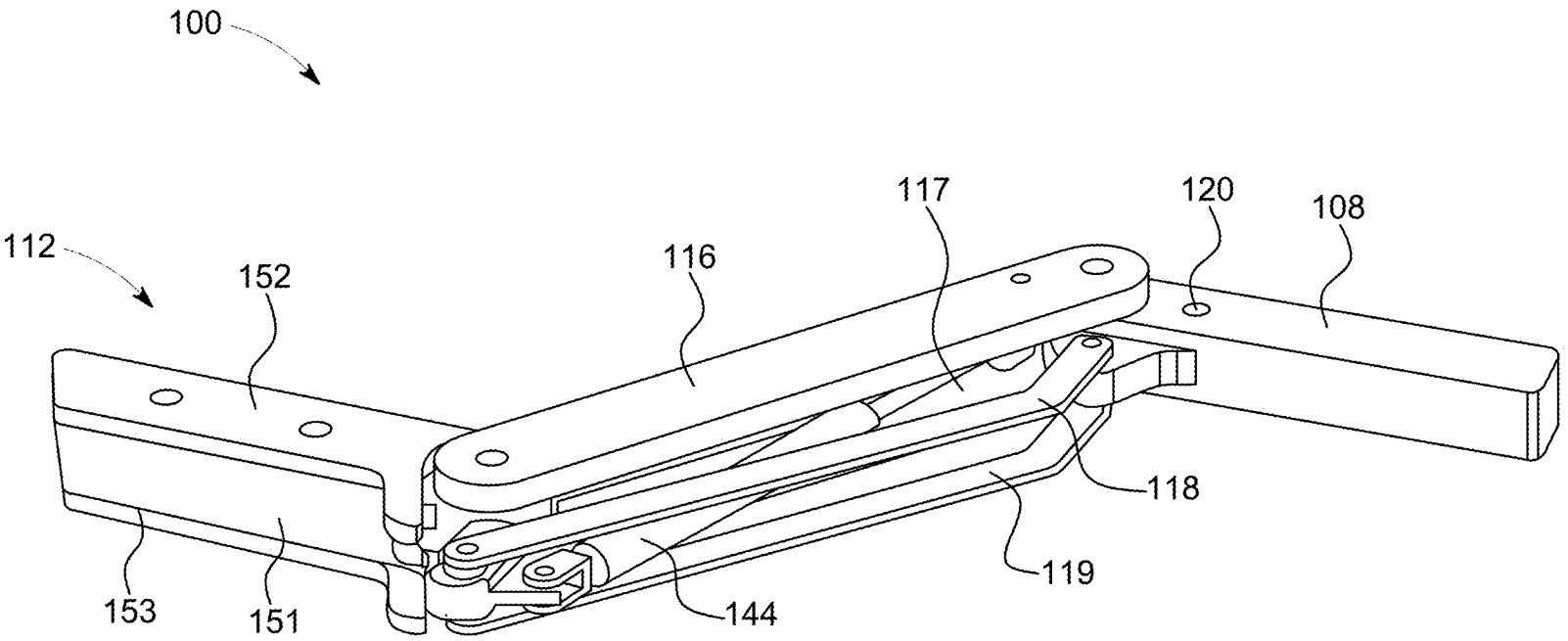
FIG. 4B shows a perspective view of an assembly in accordance with embodiments of the present invention in a raised configuration.

FIG. 4B shows a perspective view of assembly 100 in accordance with embodiments of the present invention in a raised configuration. In this view, it can be seen that there are two intermediate spars, indicated as 116 and 117, and two torque links, indicated as 118 and 119. The hydraulic cylinder 144 is disposed between the two torque links and the two intermediate spars. In embodiments, intermediate spar 116 is similar to intermediate spar 117. In embodiments, torque link 118 is similar to torque link 119.

The mounting spar 112 includes a central flange 151, a first side flange 152, and a second side flange 153. The central flange 151 is disposed between the first side flange 152 and the second side flange 153. One end of the hydraulic cylinder 144 is attached to the central flange 151, and the other end of the hydraulic cylinder 144 is attached to the intermediate spars 116 and 117.

Thus, embodiments can include a second intermediate spar rotatably connected to the mounting spar at a first end of the second intermediate spar, where the second intermediate spar is rotatably connected to the seat bracket at a second end of the second intermediate spar. Embodiments can include a first torque link rotatably connected to the mounting spar at a first end of the first torque link, where the first torque link is rotatably connected to the seat bracket at a second end of the first torque link. Embodiments can further include a second torque link rotatably connected to the mounting spar at a first end of the second torque link, where the second torque link is rotatably connected to the seat bracket at a second end of the second torque link.

Figure 5:
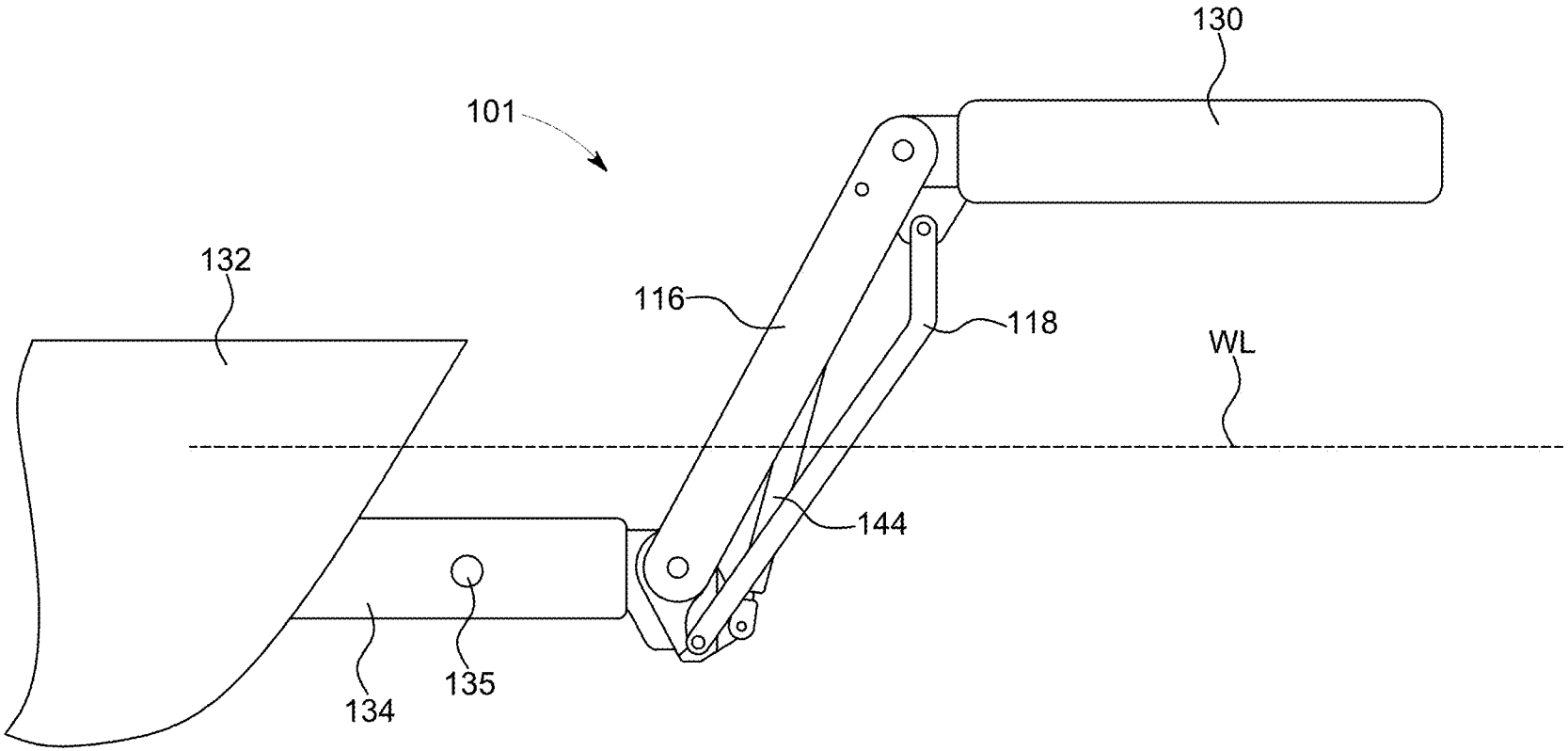
FIG. 5 shows a side view of an assembly including a seat in accordance with embodiments of the present invention in a raised configuration as installed on a watercraft.

FIG. 5 shows a side view of assembly 101 including a seat 130 in accordance with embodiments of the present invention in a raised configuration as installed on a watercraft. In the raised configuration shown in FIG. 5, the seat 130 is raised above the water level WL. In this configuration, the seat 130 can serve as a table for people on the watercraft 132. Thus, embodiments can serve as a seat or a table, depending on the configuration used. The configuration can be changed from a seat (lowered configuration) to a table (raised configuration) without needing to remove the assembly 101 from the receiver tube 134, making it convenient to switch between the two configurations.

Figure 6:
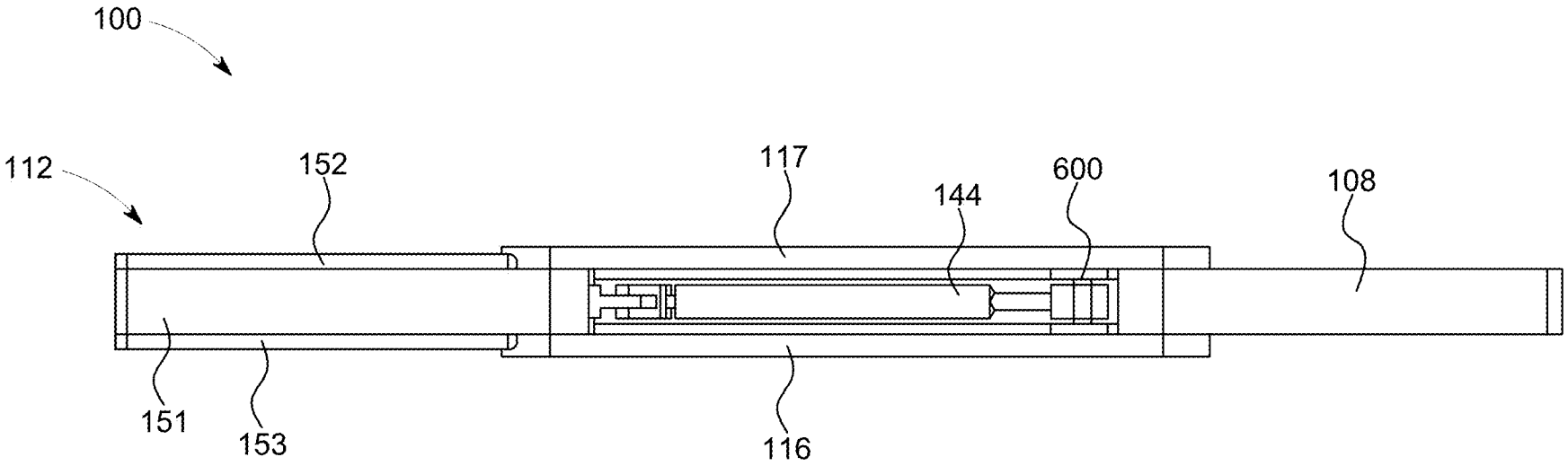
FIG. 6 shows a top-down view of an assembly in accordance with embodiments of the present invention.

FIG. 6 shows a top-down view of assembly 100 in accordance with embodiments of the present invention. As can be seen in this view, the hydraulic cylinder 144 is disposed between the first intermediate spar 116 and the second intermediate spar 117. One end of the hydraulic cylinder 144 is attached to the central flange 151, and the other end of the hydraulic cylinder 144 is attached to the pin 609 that connects to intermediate spars 116 and 117. Embodiments can include a tension member disposed between the mounting spar and the intermediate spar. In embodiments, the tension member comprises a hydraulic cylinder.

Figure 7:
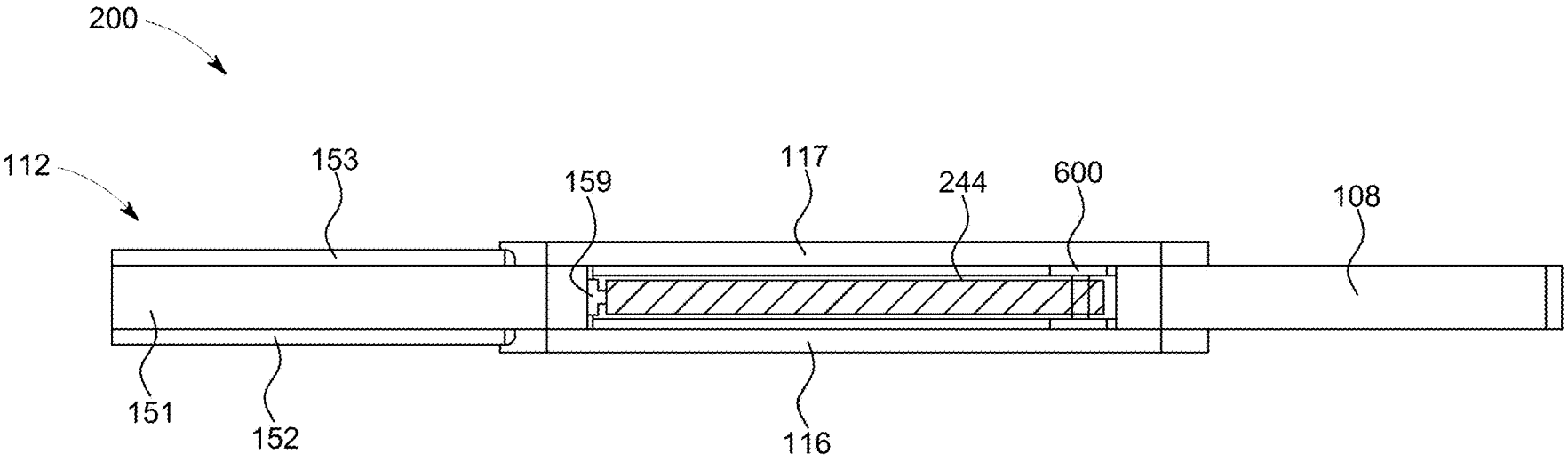
FIG. 7 shows a top-down view of an assembly in accordance with alternative embodiments of the present invention.

FIG. 7 shows a top-down view of an assembly 200 in accordance with alternative embodiments of the present invention. Assembly 200 is similar to assembly 100, with the major difference being the use of elastic band 244 used as the tension member in place of the hydraulic cylinder 144 shown in FIG. 6. In other embodiments, one or more elastic bands, springs, or cords may be used instead of, or in conjunction with, a hydraulic cylinder. As shown in FIG. 7, one end of the elastic band 244 is attached to the central flange 151 (in this case, via a connecting member 159, but not required in all embodiments), and the other end of the elastic band 244 is attached to the pin 609 that connects to intermediate spars 116 and 117. In embodiments, the tension member comprises an elastic band. Other embodiments may include a rubber band or metal spring as the tension member.

Figure 8A:
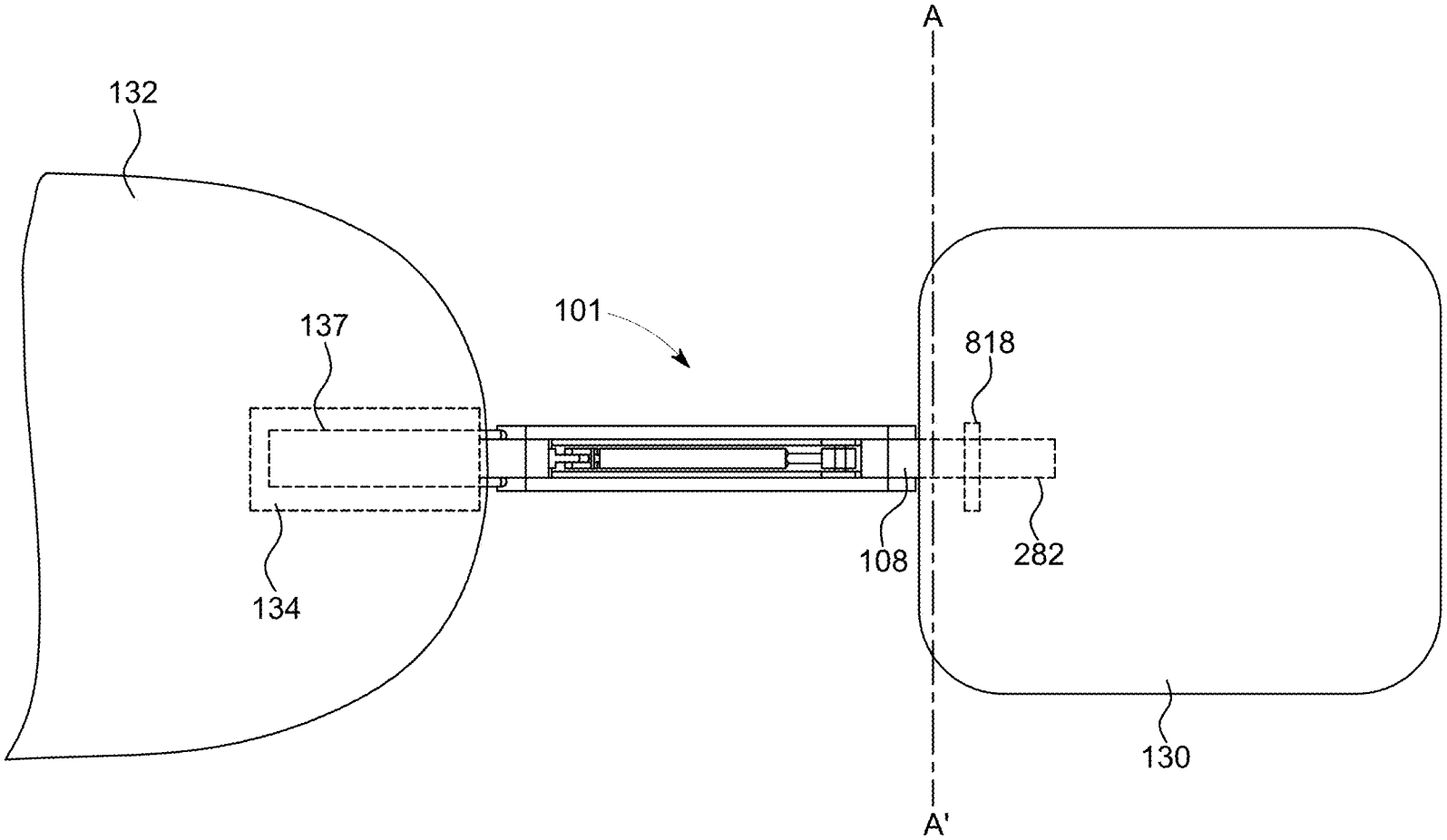
FIG. 8A shows a top-down view of an assembly including a seat in accordance with embodiments of the present invention.
Figure 8B:
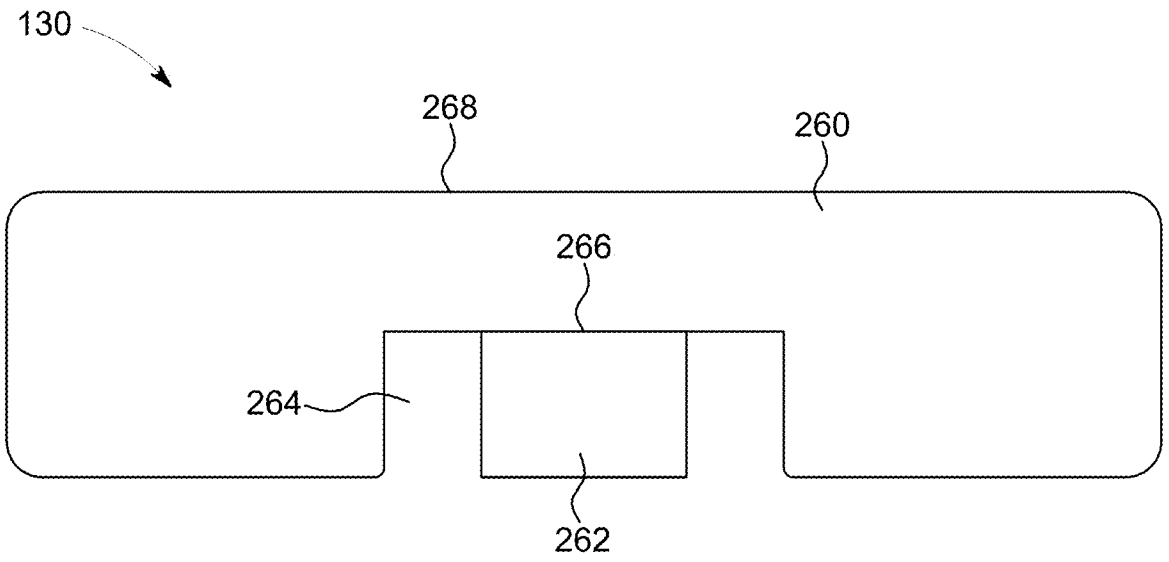
FIG. 8B is a front view of a seat in accordance with embodiments of the present invention.

FIG. 8A shows a top-down view of assembly 101 including a seat 130 in accordance with embodiments of the present invention. FIG. 8B is a front view of a seat 130 in accordance with embodiments of the present invention as viewed along line A-A' of FIG. 8A. Referring to FIG. 8A, it can be seen that the seat 130 may have a generally rectangular or square seating area. Other shapes are possible with embodiments of the present invention. A portion, indicated as 137, of the assembly 101 is inserted into receiver tube 134 to install it behind the stern of watercraft 132.

As can be seen in FIG. 8B, seat 130 comprises seat panel 260 that includes seat top surface 268. Seat top surface 268 serves as a seating surface when the seat is in the lowered configuration. Seat top surface 268 can serve as a table when the seat is in the raised configuration. The seat panel 260 includes a seat underside 266 that includes a seat underside cutout 264. A seat mounting tube 262 is affixed to the seat underside 266. To assemble an apparatus in accordance with disclosed embodiments, the seat bracket 108 is inserted in the seat mounting tube 262. A bolt 818 (FIG. 8A), is then passed through an opening in the seat mounting tube 262 and the opening 120 (FIG. 1) within the seat bracket, in order to fasten the seat 130 to the seat bracket 108. It should be recognized that the seat can be attached to the assembly 100 in other suitable manners within the scope of embodiments of the present invention.

Figure 9A:
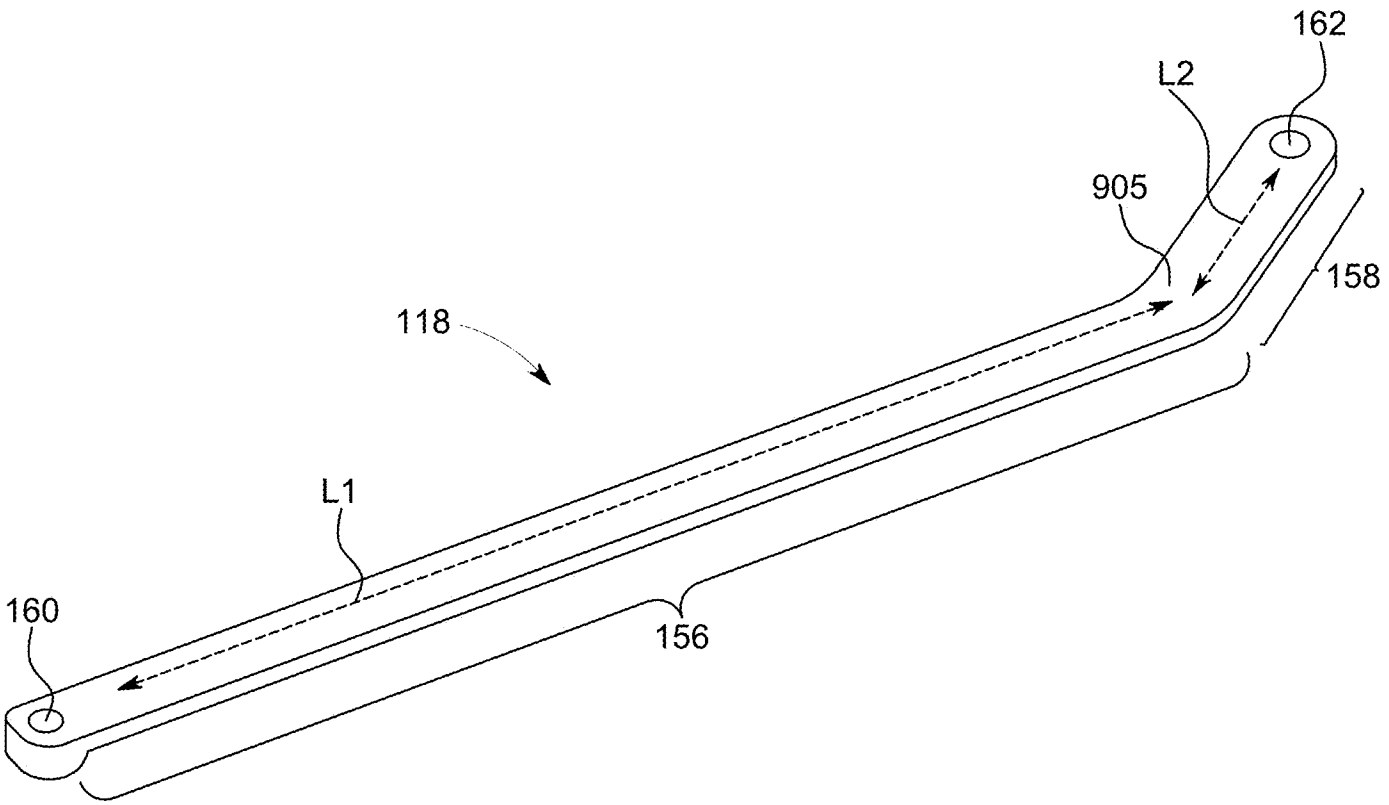
FIG. 9A shows a perspective view of a torque link in accordance with embodiments of the present invention.

FIG. 9A shows a perspective view of a torque link 118 in accordance with embodiments of the present invention. Torque link 118 comprises a first torque link mounting opening 160 at a first end, and a second torque link mounting opening 162 at a second end. The torque link has a bend in it at an intermediate location indicated at 905. The torque link 118 comprises a major segment 156 and a minor segment 158. The major segment 156 includes the first torque link mounting opening 160, and extends to the bend at location 905. The minor segment includes the second torque link mounting opening 162, and extends to the bend at location 905. In embodiments, the ratio of the length L1 of the major segment 156 to the length L2 of minor segment 158 may range from 3 to 5.

Figure 9B:
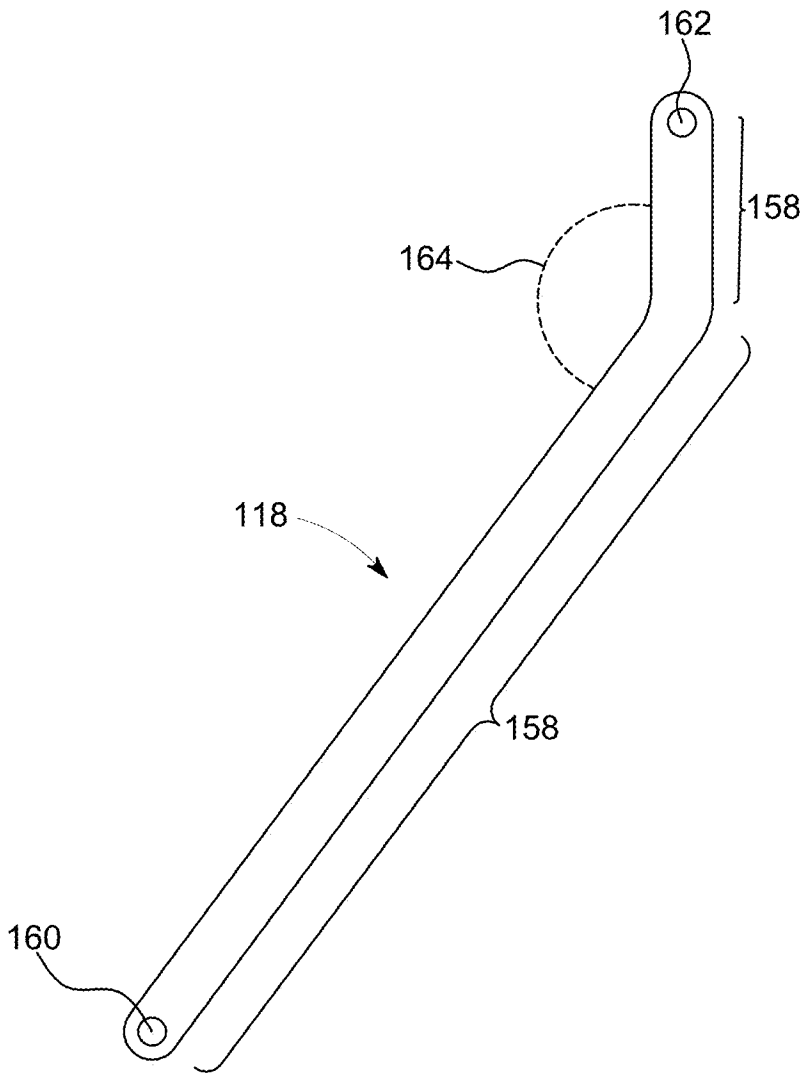
FIG. 9B shows a side view of a torque link in accordance with embodiments of the present invention.

FIG. 9B shows a side view of torque link 118 in accordance with embodiments of the present invention. In this view, the angle 164 between the major segment 156 and minor segment 158 is shown. In embodiments, the angle 164 has a value ranging from 110 degrees to 130 degrees. In some embodiments, the angle 164 has a value ranging from 118 degrees to 122 degrees. Thus, in embodiments, the torque link comprises an angle formed at an intermediate location within the torque link.

Figure 10:
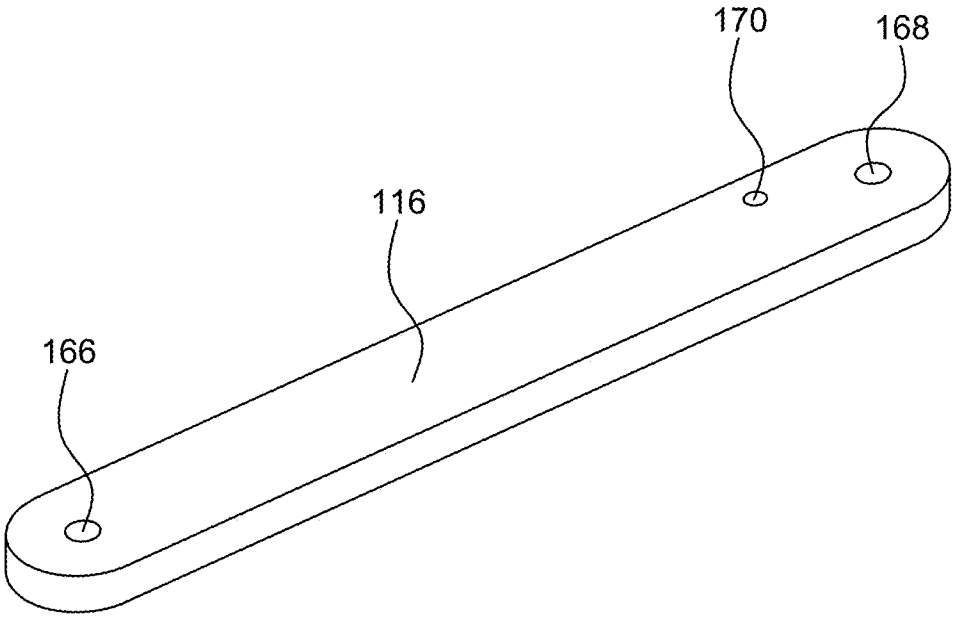
FIG. 10 shows a perspective view of an intermediate spar in accordance with embodiments of the present invention.

FIG. 10 shows a perspective view of an intermediate spar 116 in accordance with embodiments of the present invention. Intermediate spar 116 comprises first intermediate spar mounting opening 168, tension member attachment opening 170, and second intermediate spar mounting opening 166. The tension member (e.g., hydraulic cylinder, elastic band) is attached via tension member attachment opening 170.

Figure 11A:
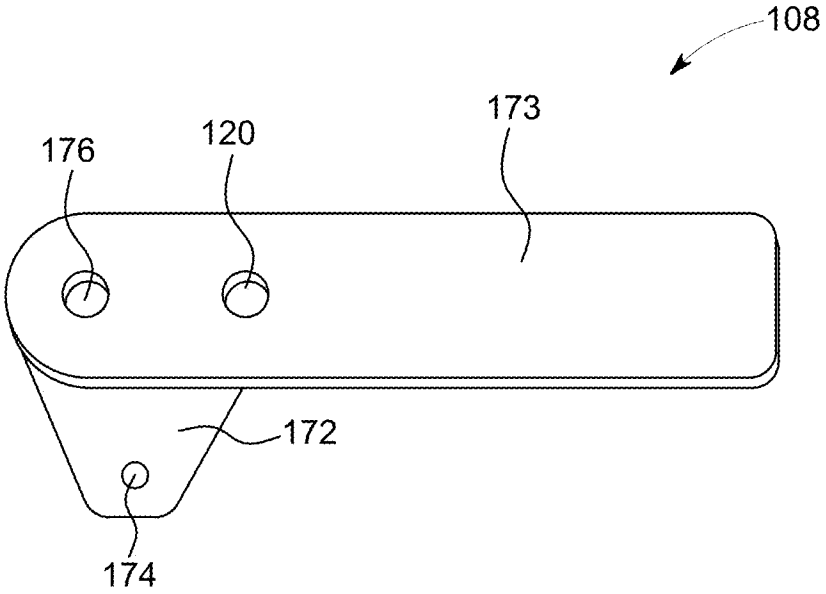
FIG. 11A shows a side view of a seat bracket in accordance with embodiments of the present invention.
Figure 11B:
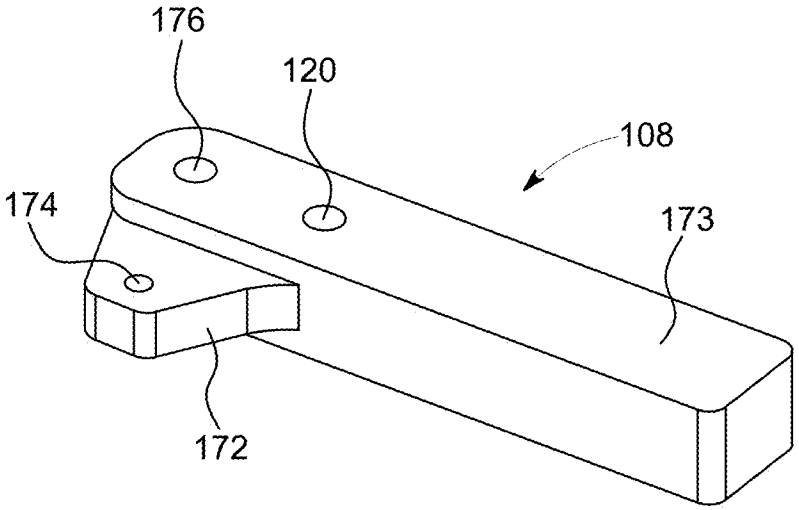
FIG. 11B shows a perspective view of a seat bracket in accordance with embodiments of the present invention.

FIG. 11A shows a side view of a seat bracket 108 in accordance with embodiments of the present invention. FIG. 11B shows a perspective view of seat bracket 108 in accordance with embodiments of the present invention. Seat bracket 108 comprises bracket block 173, and torque link mounting lip 172 adjoined to the bracket block 173. Torque link attachment opening 174 is formed within torque link mounting lip 172. Seat attachment opening 120 is formed within the bracket block 173 of the seat bracket 108 and is used for attaching a seat (e.g., 130 of FIG. 5) thereto. Intermediate spar mounting opening 176 is formed on the end of the bracket block 173 that adjoins the torque link mounting lip 172.

Figure 12:
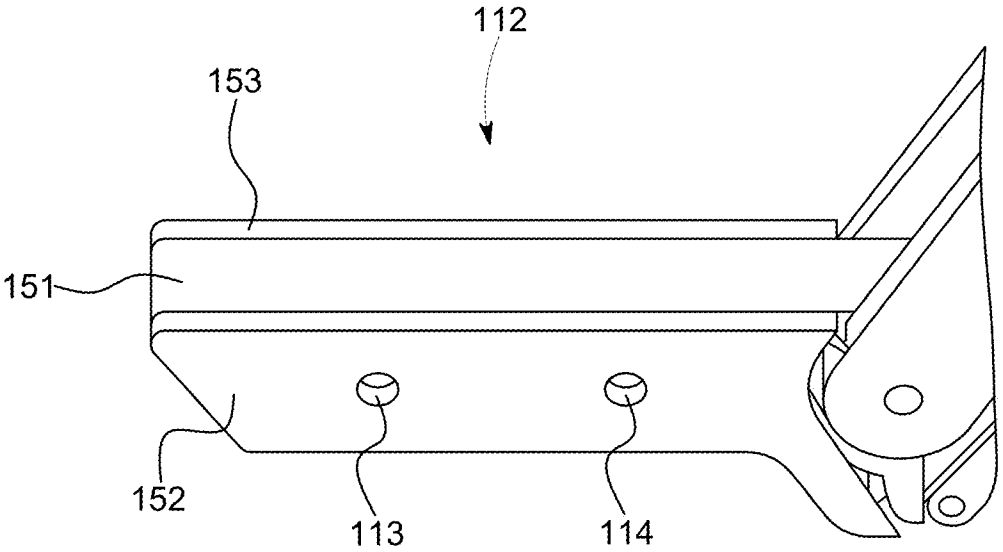
FIG. 12 shows a perspective view of a mounting spar in accordance with embodiments of the present invention.

FIG. 12 shows a perspective view of a mounting spar 112 in accordance with embodiments of the present invention. Mounting spar 112 comprises a central flange 151 which is bounded by a first slide flange 152 and a second side flange 153. In embodiments, the first slide flange 152 is similar to the second side flange 153. Side flange 152 comprises first mounting spar opening 113 and second mounting spar opening 114. These openings may be used to secure the apparatus to a receiver tube via hitch pins. Second side flange 153 has similar openings aligned such that a pin may be passed through the mounting spar 112. Some embodiments may use other mounting mechanisms instead of, or in addition to, those shown in FIG. 11A, FIG. 11B, and FIG. 12.

Figure 13A:
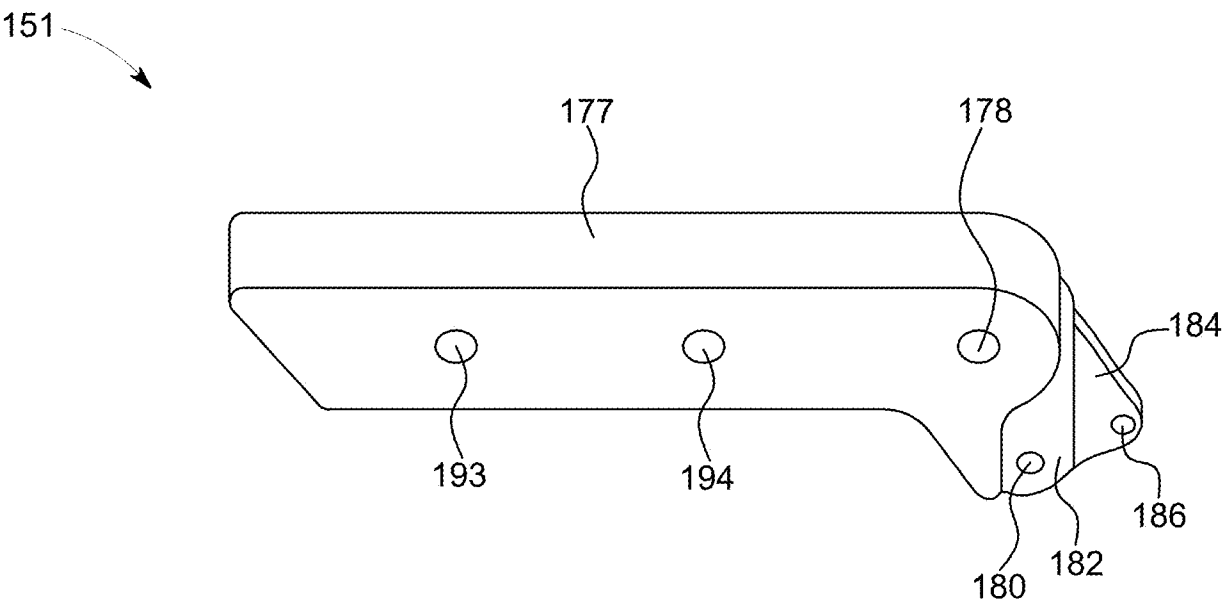
FIG. 13A shows a perspective view of a central flange in accordance with embodiments of the present invention.

FIG. 13A shows a perspective view of a central flange 151 in accordance with embodiments of the present invention. Central flange 151 includes bracket block 177. A first central flange opening 193 is positioned to align with first mounting spar opening 113 shown in FIG. 12. A second central flange opening 194 is positioned to align with second mounting spar opening 114 shown in FIG. 12. Intermediate spar mounting opening 178 is formed in the bracket block, allowing connection of intermediate spars (e.g., 116 and 117 of FIG. 4B). Torque link mounting lip 182 is adjoined to bracket block 177. Tension member lip 184 is adjoined to torque link mounting lip 182. The torque links (e.g., 118 and 119 of FIG. 4B) are rotatably fastened to the central flange 151 via torque link attachment opening 180. The tension member (e.g., hydraulic cylinder 144 of FIG. 4B, elastic band 244 of FIG. 7) are rotatably fastened to the central flange 151 via tension member attachment opening 186.

Figure 13B:
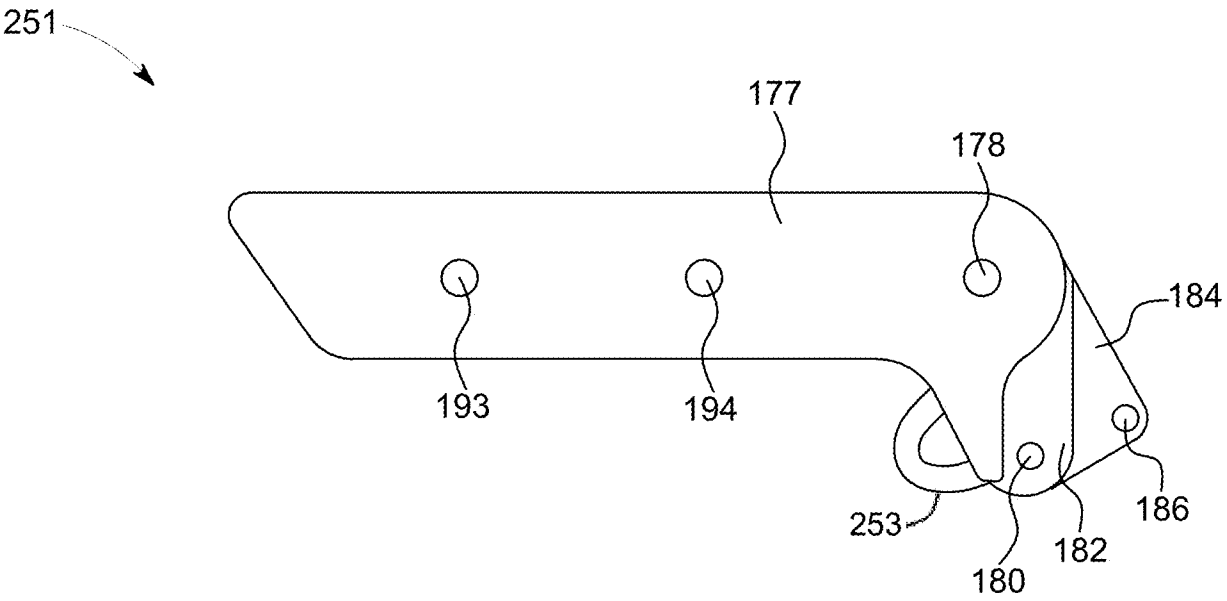
FIG. 13B shows a side view of a central flange in accordance with additional embodiments of the present invention.

FIG. 13B shows a side view of a central flange 251 in accordance with additional embodiments of the present invention. Central flange 251 is similar to central flange 151 of FIG. 13A, with the addition of a tether loop 253. The tether loop 253 can be used to provide an additional connection to a watercraft via a rope, cable, chain or similar item, to provide additional security if the apparatus is disconnected from the receiver tube.

Figure 13C:
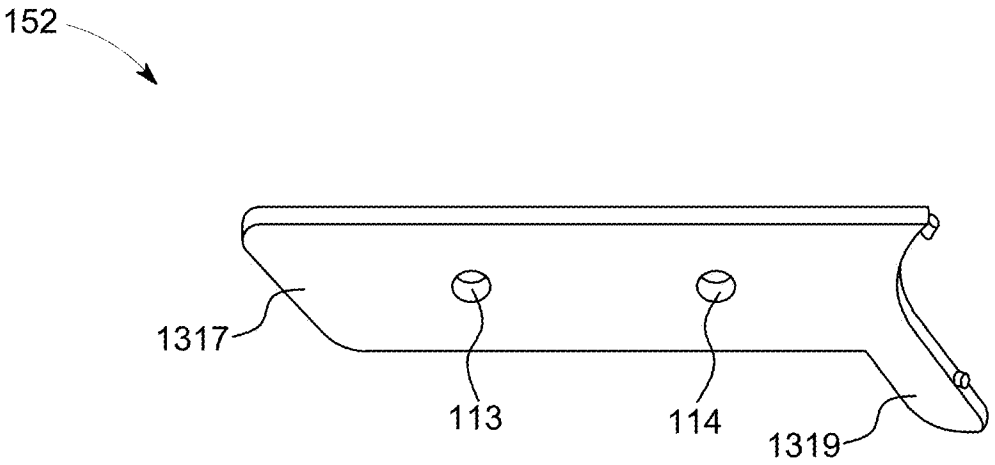
FIG. 13C shows a perspective view of a side flange in accordance with embodiments of the present invention.

FIG. 13C shows a perspective view of a side flange 152 in accordance with embodiments of the present invention. Side flange 152 includes main body 1317, having a first mounting spar opening 113 and a second mounting spar opening 114 formed therein. The openings 113 and 114 can be used to receive a hitch pin to secure the mounting spar to the receiver tube. Side flange 152 further includes lower lip 1319 which adjoins main body 1317.

Figure 14:
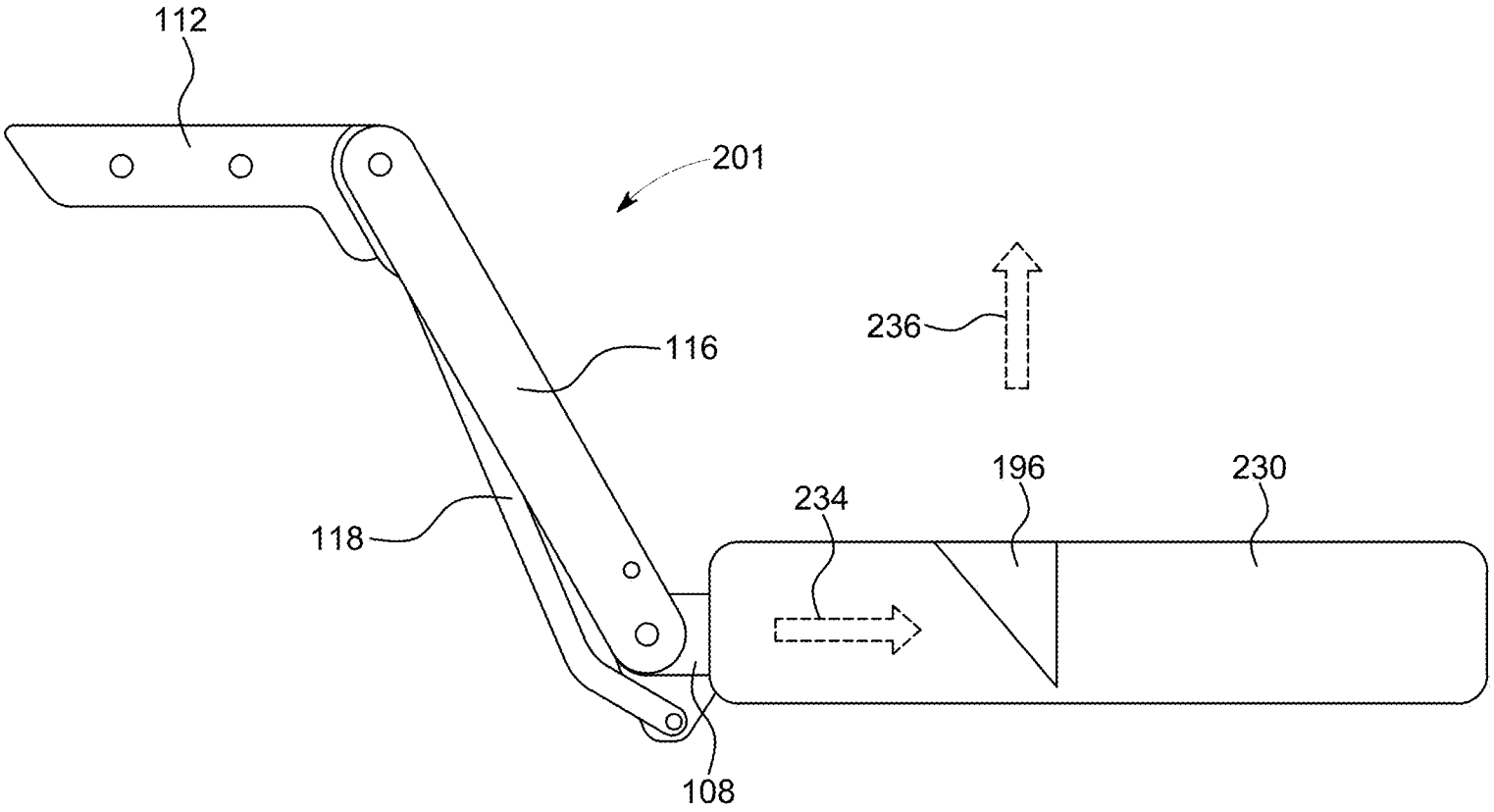
FIG. 14 shows a side view of an assembly including a seat with a hydrofoil cup holder in accordance with additional embodiments of the present invention in a lowered configuration.

FIG. 14 shows a side view of an assembly 201 including a seat with a hydrofoil cup holder 196 in accordance with additional embodiments of the present invention in a lowered configuration. Assembly 201 is similar to assembly 101 shown in FIG. 2, with the addition of hydrofoil cup holder 196. Hydrofoil cup holder 196 is affixed to seat 230. When the attached watercraft moves forward, water exerts a lateral force indicated by arrow 234, which causes the hydrofoil cup holder 196 to move upwards in the direction indicated by arrow 236, causing the seat 230 to raise. In this way, as a watercraft moves forward, unoccupied seat 230 moves in the direction indicated by arrow 236 automatically, without manual intervention, thereby automatically moving the apparatus into a raised configuration in response to forward motion of the watercraft. Embodiments can include a hydrofoil affixed to the seat. In some embodiments, the hydrofoil includes an integrated cup holder.

Figure 15:
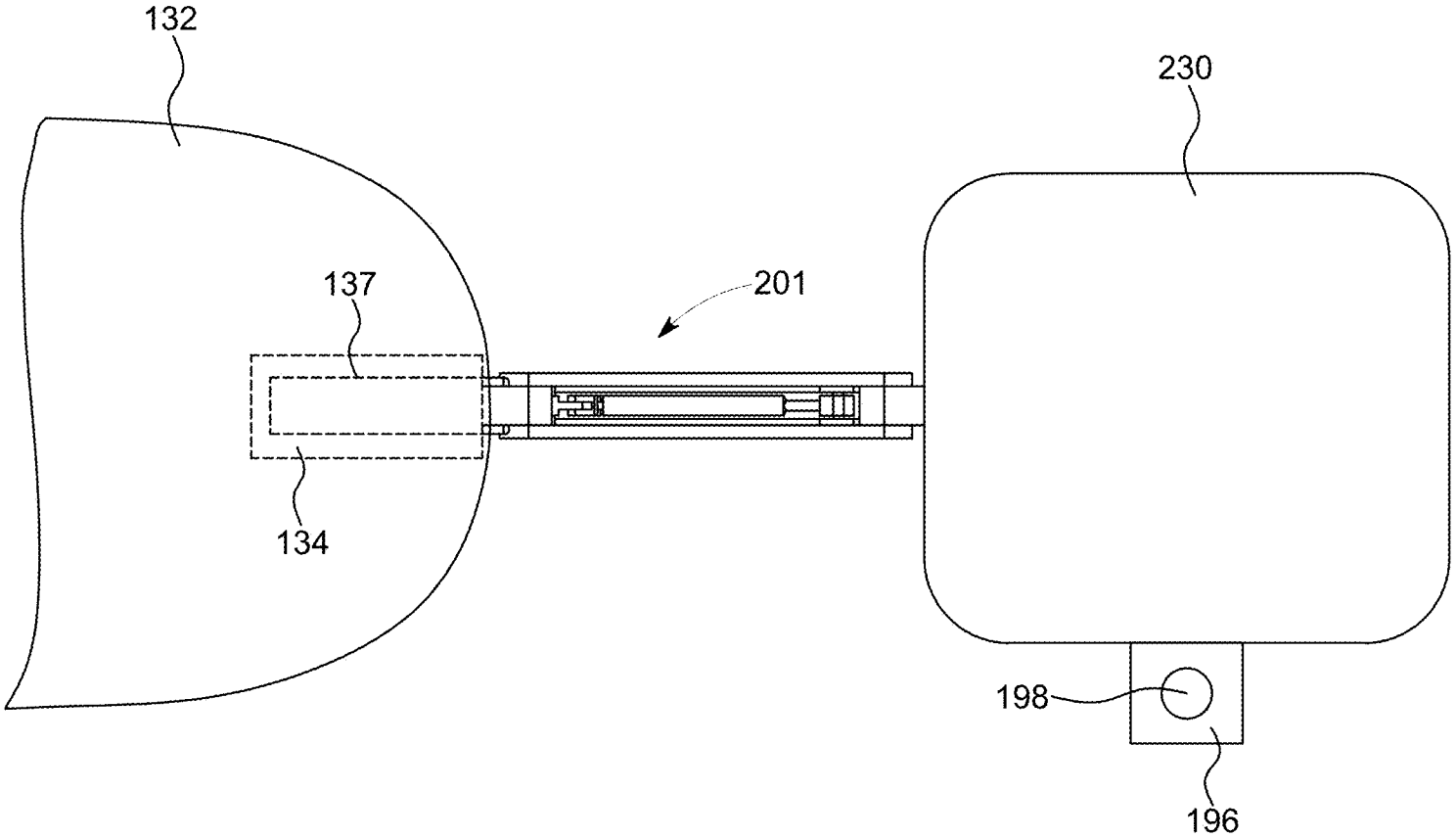
FIG. 15 shows a top-down view of an assembly including a seat with a hydrofoil cup holder in accordance with additional embodiments of the present invention.

FIG. 15 shows a top-down view of assembly 201 including a seat with a hydrofoil cup holder in accordance with additional embodiments of the present invention. As can be seen in this view, hydrofoil cup holder 196 is affixed to a side of seat 230. A recess 198 is formed within the hydrofoil cup holder 196. In embodiments, the recess 198 is circular and sized as to accommodate typical-sized beverage containers such as bottles, cups, and cans.

Figure 16A:
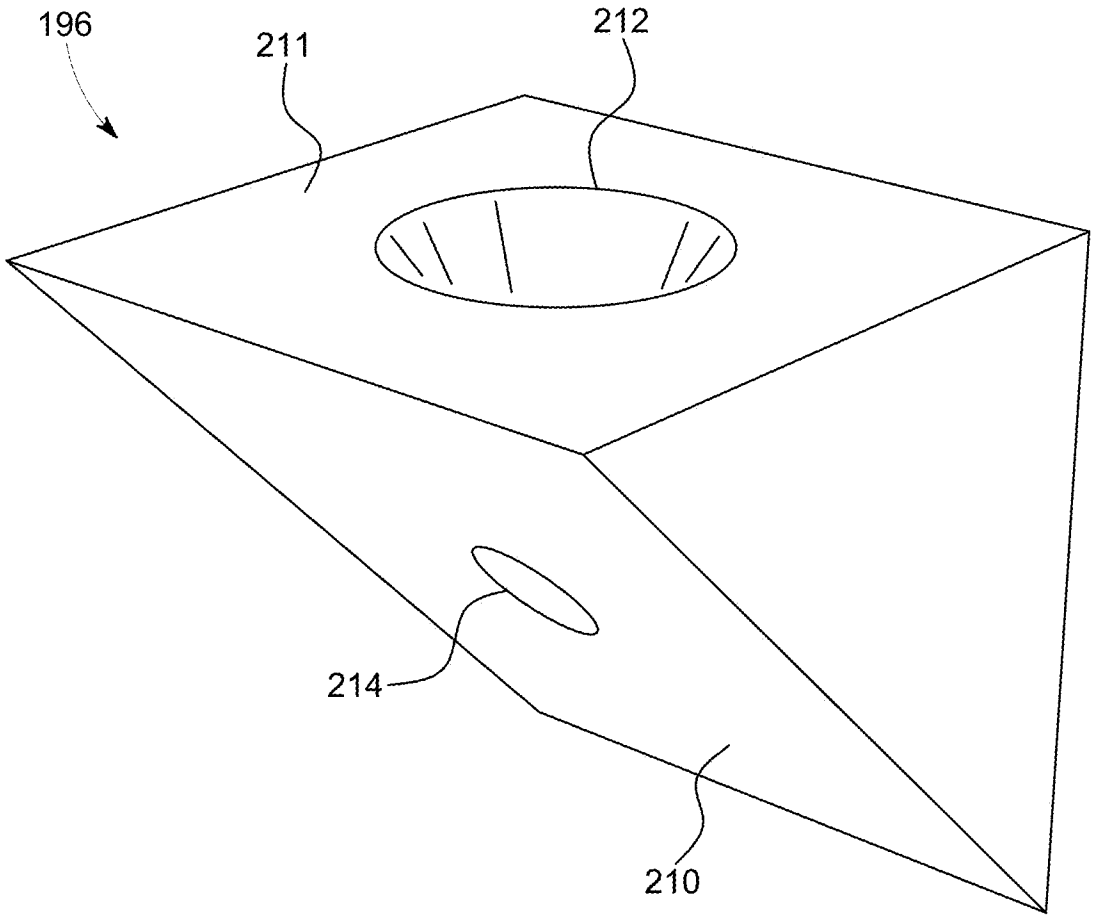
FIG. 16A shows a perspective view of a hydrofoil cup holder in accordance with additional embodiments of the present invention.
Figure 16B:
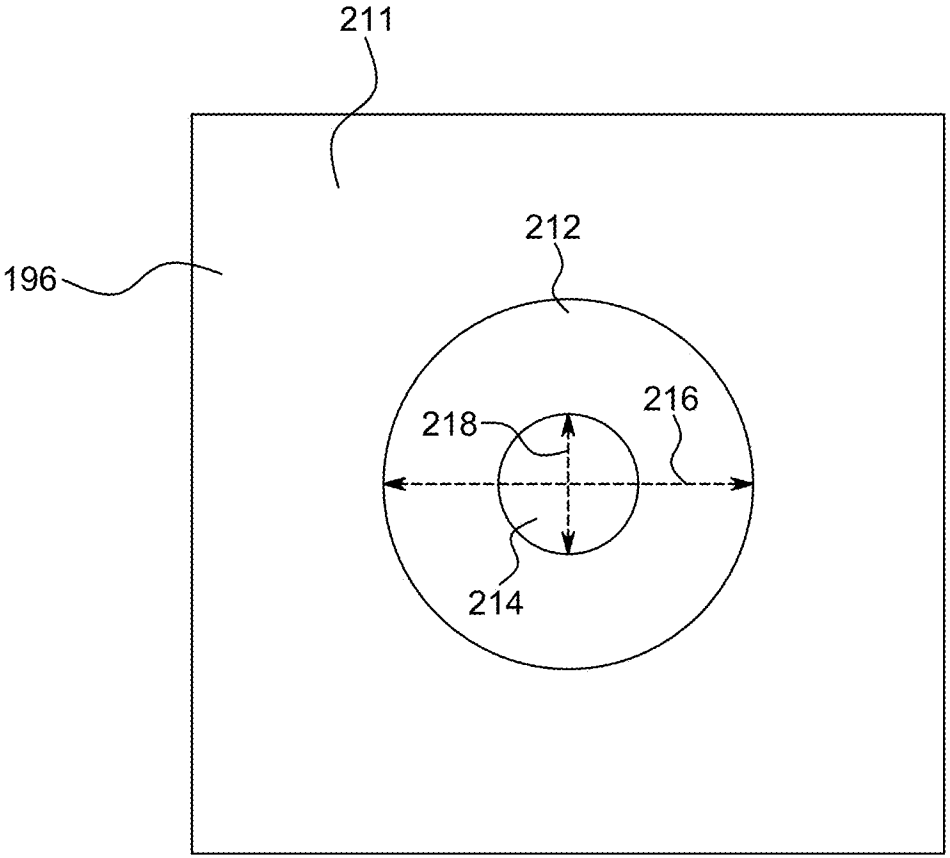
FIG. 16B shows a top-down view of the hydrofoil cup holder of FIG. 16A.

FIG. 16A shows a perspective view of a hydrofoil cup holder 196 in accordance with additional embodiments of the present invention. FIG. 16B shows a top-down view of the hydrofoil cup holder 196 of FIG. 16A. Hydrofoil cup holder 196 comprises a front-facing surface 210 and a top surface 211. A top opening 212 is formed in the top surface 211 of the hydrofoil cup holder 196. A bottom opening 214 is formed in the front facing surface 210. Referring specifically to FIG. 16B, the top opening 212 has diameter 216, and the bottom opening 214 has diameter 218. The top opening 212 has a larger diameter than bottom opening 214. Thus, a beverage container that can fit through the top opening 212 but cannot fit through the bottom opening 214 is held in place within the hydrofoil cup holder 196.

Figure 16C:
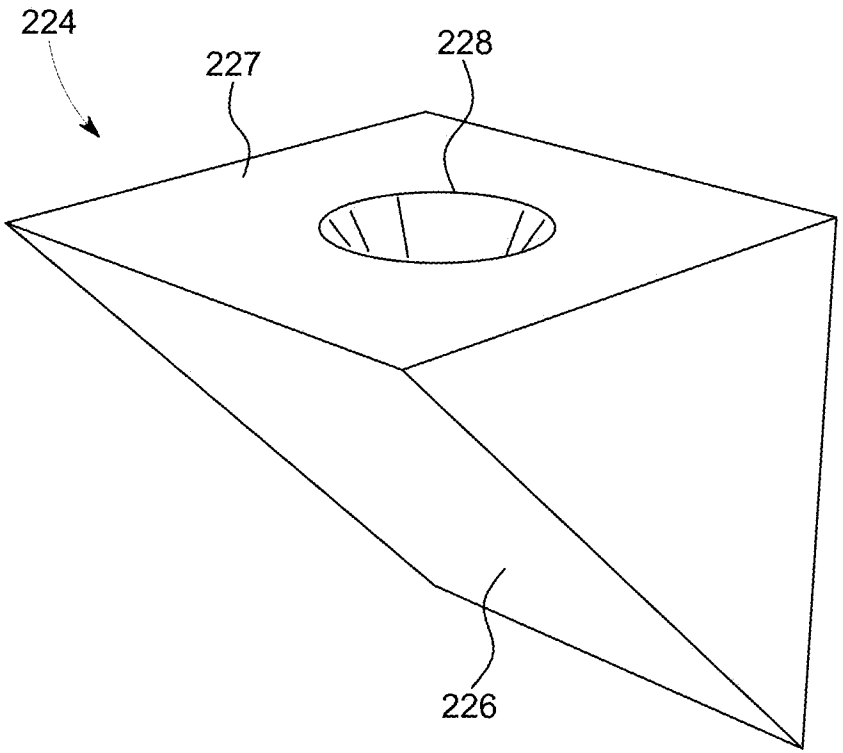
FIG. 16C shows a perspective view of a hydrofoil cup holder in accordance with additional embodiments of the present invention.
Figure 16D:
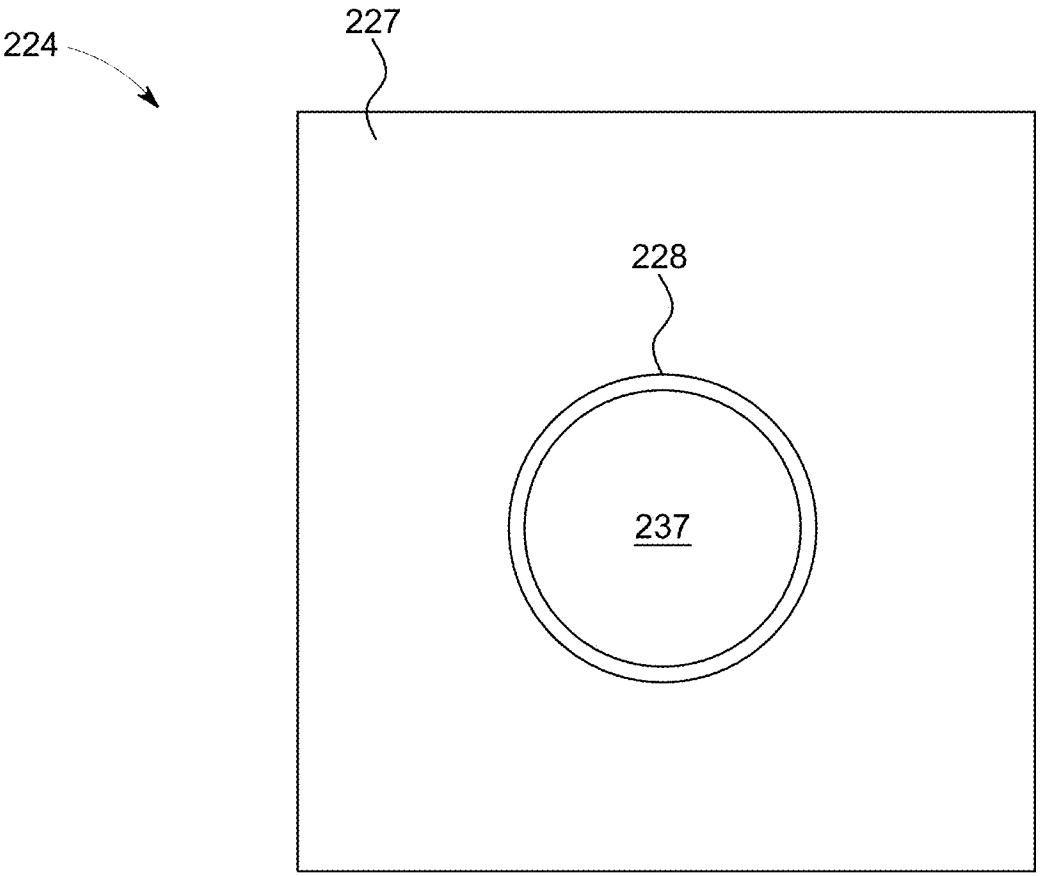
FIG. 16D shows a top-down view of the hydrofoil cup holder of FIG. 16C.

FIG. 16C shows a perspective view of a hydrofoil cup holder 224 in accordance with additional embodiments of the present invention. FIG. 16D shows a top-down view of the hydrofoil cup holder 224 of FIG. 16C.

Hydrofoil cup holder 224 comprises a front-facing surface 226 and a top surface 227. An opening 228 is formed in the top surface 227 of the hydrofoil cup holder 224. Unlike the hydrofoil cup holder 196 shown in FIG. 16A and FIG. 16B, there is no bottom opening in hydrofoil cup holder 224. Referring specifically to FIG. 16D, there is a bottom surface 237 formed in the opening 228 such that a beverage container can rest on bottom surface 237 and be held in place by the hydrofoil cup holder 224.

Hydrofoil cup holders 196 and 224 can serve as hydrofoils when the apparatus is in a lowered configuration, urging the seat upwards as the attached watercraft moves forward. Hydrofoil cup holders 196 and 224 can serve as cup holders when the apparatus is in a raised configuration, securing a beverage container while the seat is being used as a table.

Figure 17:
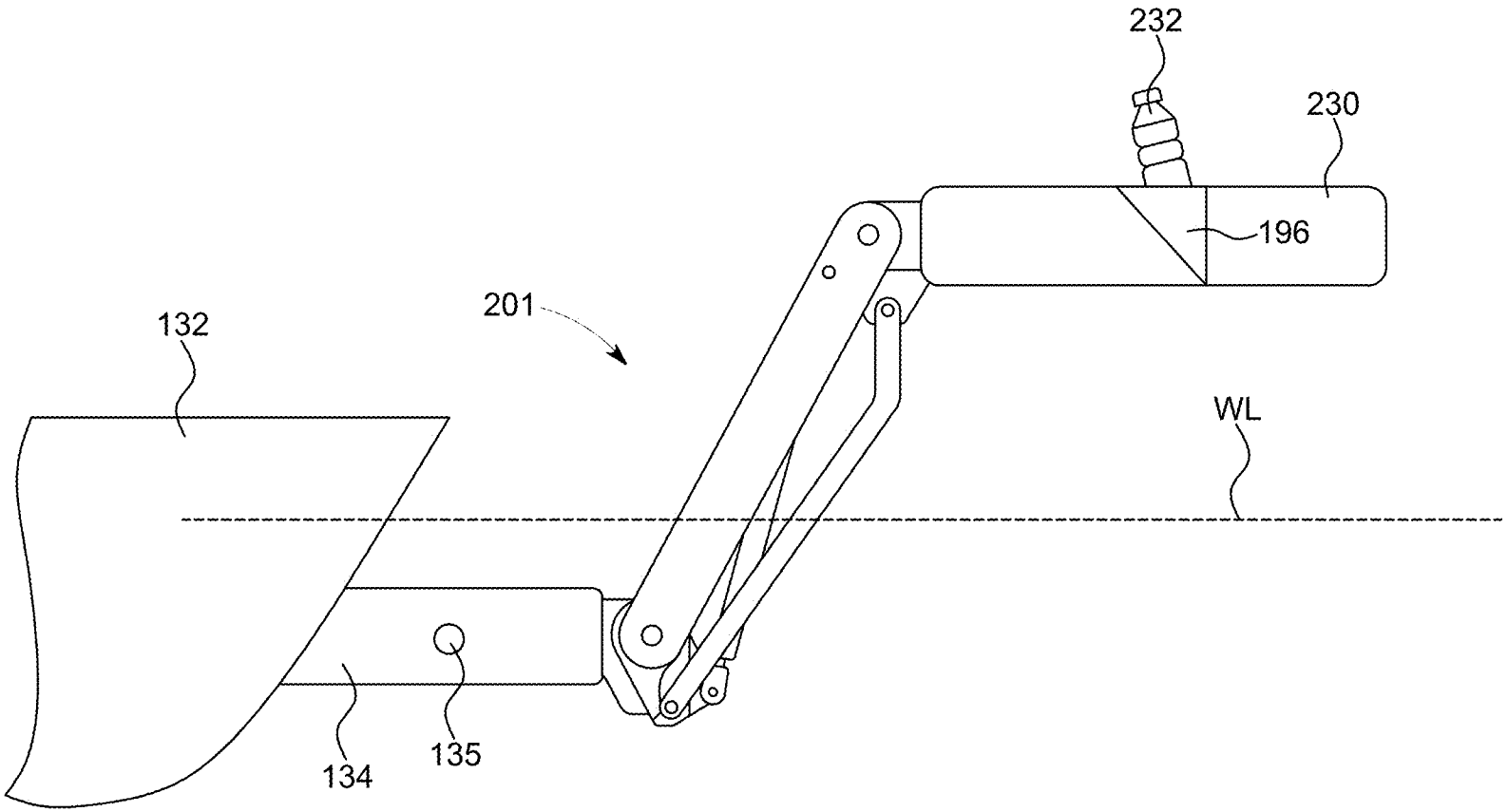
FIG. 17 shows a side view of an assembly including a seat with a hydrofoil cup holder in accordance with additional embodiments of the present invention in a raised configuration.

FIG. 17 shows a side view of an assembly 201 including a seat with a hydrofoil cup holder 196 in accordance with additional embodiments of the present invention in a raised configuration. A beverage container 232 is shown stored within hydrofoil cup holder 196.

Figure 18:
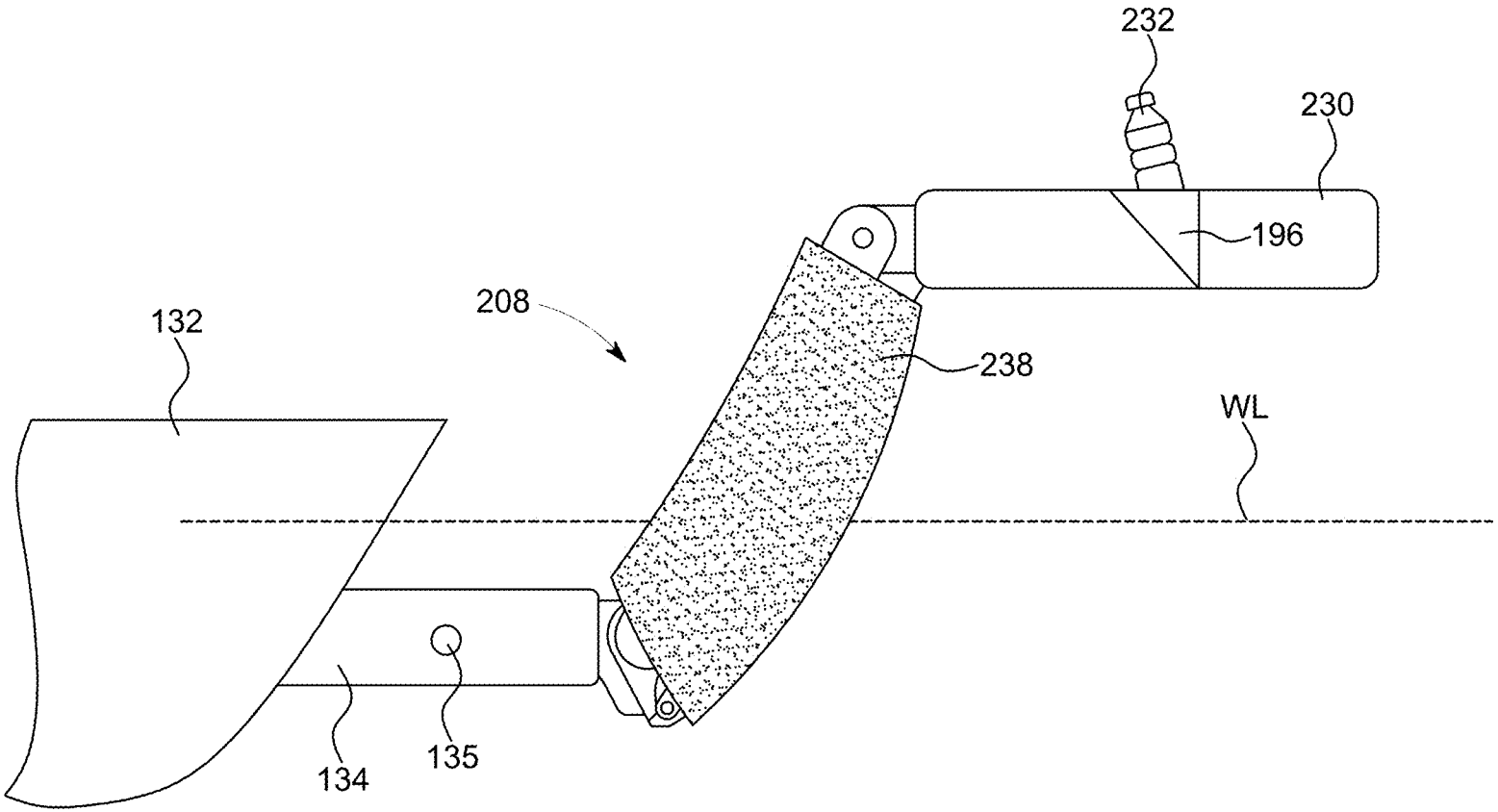
FIG. 18 shows a side view of an assembly including a protective sleeve in accordance with additional embodiments of the present invention in a raised configuration.

FIG. 18 shows a side view of an assembly 288 including a protective sleeve 238 in accordance with additional embodiments of the present invention in a raised configuration. Protective sleeve 238 may be comprised of a flexible material such as neoprene, rubber, or other suitable material. The sleeve 238 covers the moving parts including the intermediate spars and tension members, in order to keep debris and appendages such as fingers away from moving parts within the assembly, such as the intermediate spars. Thus, embodiments can include a sleeve disposed around the first intermediate spar and second intermediate spar.

Figure 19:
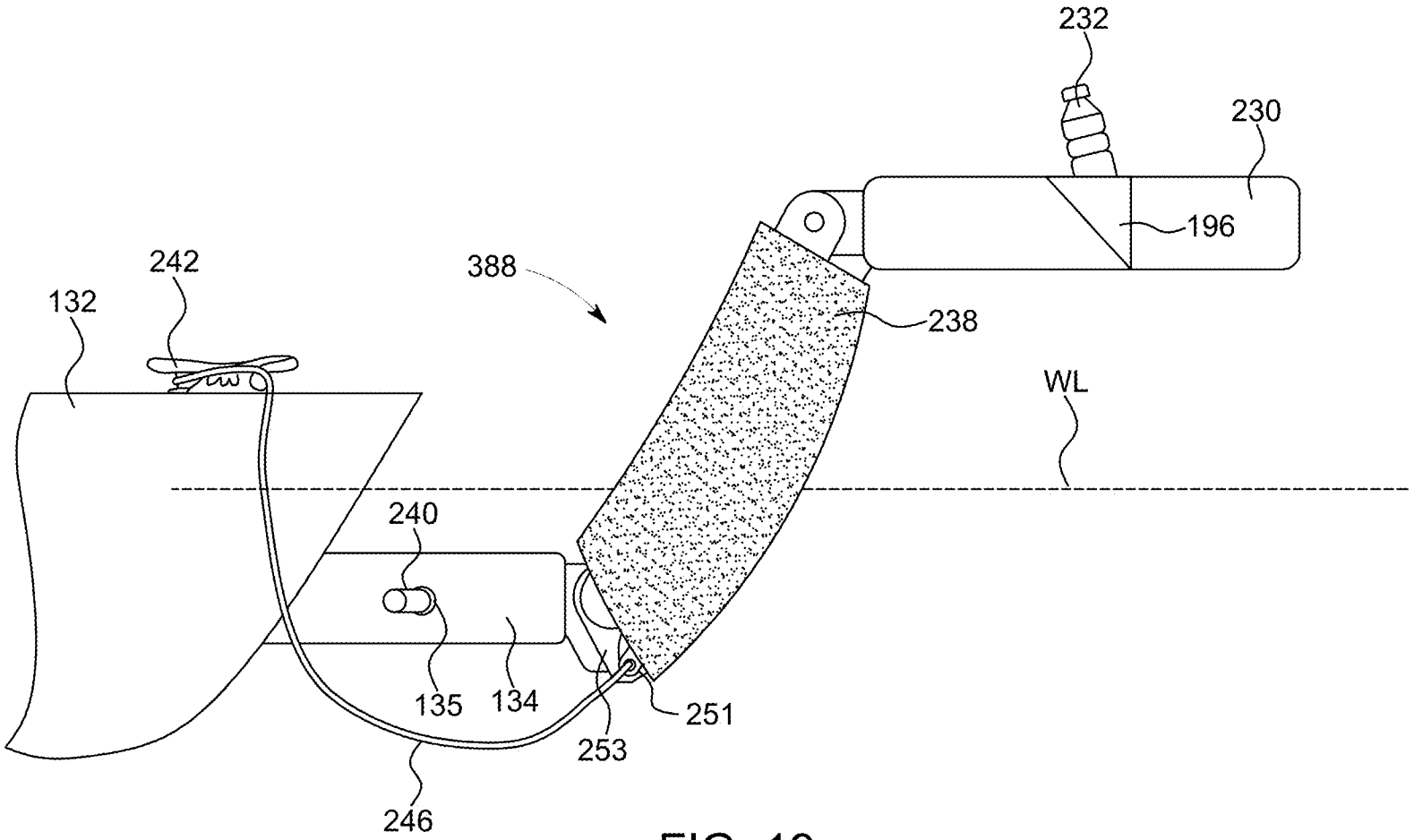
FIG. 19 shows a side view of an assembly illustrating use of a tether hook in accordance with additional embodiments of the present invention.

FIG. 19 shows a side view of an assembly 388 illustrating use of a tether hook in accordance with additional embodiments of the present invention. Assembly 388 is similar to assembly 288 of FIG. 18, with the main difference being the use of central flange 251, which includes tether loop 253. During use, a rope 246 may be secured to the tether loop 253 and also to an attachment point 242, such as a cleat, on the watercraft 132. Additionally, a hitch pin 240 may be inserted through lateral opening 135, and through a mounting spar opening (e.g., 113 or 114 on FIG. 12), to provide additional security for the assembly 388 to ensure it remains attached to the watercraft 132.

Figure 20:
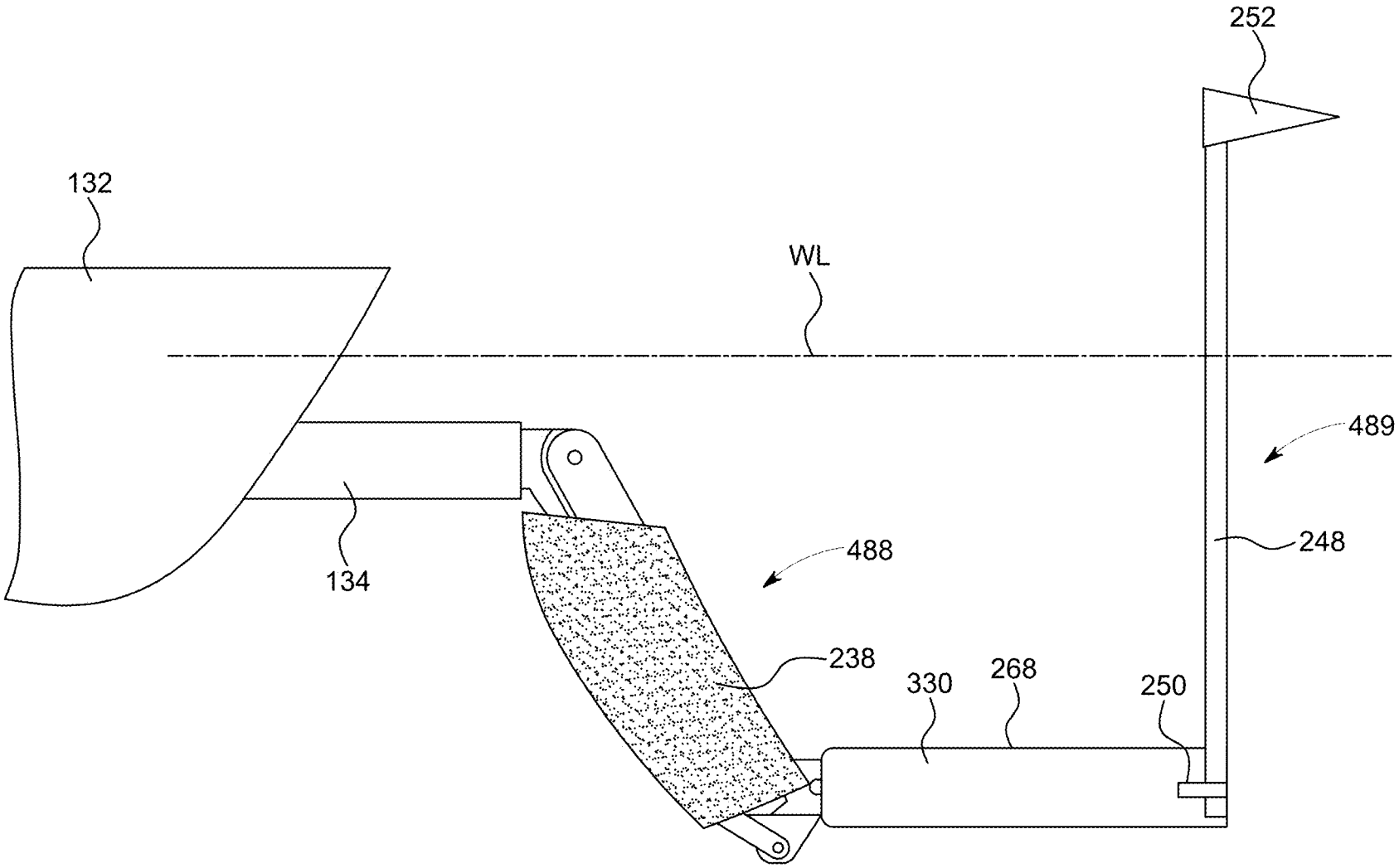
FIG. 20 shows a side view of an assembly illustrating use of a submerged safety indicator in accordance with additional embodiments of the present invention.

FIG. 20 shows a side view of an assembly 488 illustrating use of a submerged safety indicator in accordance with additional embodiments of the present invention. Assembly 488 is similar to assembly 388, with a main difference being the incorporation of a submerged safety indicator 489. In embodiments, the submerged safety indicator 489 includes a pole 248 affixed to seat 330 via bracket 250. A visible indicator such as a pennant 252 or colored tip is affixed to the upper end of the pole 248. This serves as an alert that the seat 330 is submerged below the water level WL. In embodiments, the submerged safety indicator comprises a pole affixed to the seat in a substantially perpendicular orientation to a seat top surface 268 (see also, 268 of FIG. 8B). Embodiments can further include a pennant affixed to one end of the pole.

While a variety of embodiments are disclosed and shown, other embodiments can include other combinations of features, such as a hydrofoil cup holder, submerged safety indicator, tether loop, and others. Some embodiments may include multiple hydrofoil cup holders, submerged safety indicators, and/or tether hooks.

As can now be appreciated, disclosed embodiments provide an apparatus that includes a submersible seating surface attached to a watercraft. The submersible seating surface may be raised to serve as a table when not in use as a seat. A tension member such as a hydraulic cylinder is used to provide upward force on the seat to allow it to be easily raised from a lowered position where it is submerged in water, to a raised position, where it is out of the water. In embodiments, the lower position is used as a seat. This allows a person to sit in the water with the seat secured to the watercraft. In embodiments, the upper position is used as a table. In some embodiments, a tether is used to provide additional security for the apparatus in the event it becomes disconnected from the watercraft. In some embodiments, a hydrofoil cup holder is affixed to the seating surface to provide additional lift when a watercraft is moving forward, such that the hydrofoil urges the seat upward and out of the water. The hydrofoil cup holder further includes an opening in a top surface of the cup holder to secure an item such as a beverage container when the apparatus is used as a table. Embodiments may further include a submerged safety indicator to alert nearby swimmers and/or people on the watercraft of the submerged seat. Thus, disclosed embodiments provide additional capability for a watercraft such as a boat to enhance enjoyment while using a watercraft.

While the invention has been particularly shown and described in conjunction with exemplary embodiments, it will be appreciated that variations and modifications will occur to those skilled in the art. For example, although the illustrative embodiments are described herein as a series of acts or events, it will be appreciated that the present invention is not limited by the illustrated ordering of such acts or events unless specifically stated. Some acts may occur in different orders and/or concurrently with other acts or events apart from those illustrated and/or described herein, in accordance with the invention. In addition, not all illustrated steps may be required to implement a methodology in accordance with the present invention. Furthermore, the methods according to the present invention may be implemented in association with the formation and/or processing of structures illustrated and described herein as well as in association with other structures not illustrated. Moreover, in particular regard to the various functions performed by the above described components (assemblies, devices, circuits, etc.), the terms used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application. Therefore, it is to be understood that the appended claims are intended to cover all such modifications and changes that fall within the true spirit of the invention.

What is claimed is:

1. An apparatus comprising:

a mounting spar;

a first intermediate spar rotatably connected to the mounting spar at a first end of the first intermediate spar;

a seat bracket, the seat bracket rotatably connected to a second end of the first intermediate spar;

a seat, the seat affixed to the seat bracket; and a first torque link rotatably connected to the mounting spar at a first end of the first torque link, wherein the first torque link is rotatably connected to the seat bracket at a second end of the first torque link and comprises an angle ranging from 110 degrees to 130 degrees formed at an intermediate location within the first torque link.

2. An apparatus comprising:

a mounting spar;

a first intermediate spar rotatably connected to the mounting spar at a first end of the first intermediate spar;

a seat bracket, the seat bracket rotatably connected to a second end of the first intermediate spar;

a seat, the seat affixed to the seat bracket;

a second intermediate spar rotatably connected to the mounting spar at a first end of the second intermediate spar, and wherein the second intermediate spar is rotatably connected to the seat bracket at a second end of the second intermediate spar; and a sleeve disposed around the first intermediate spar and second intermediate spar.

3. The apparatus of claim 2, wherein the sleeve is comprised of neoprene.

4. An apparatus comprising:

a mounting spar;

a first intermediate spar rotatably connected to the mounting spar at a first end of the first intermediate spar;

a second intermediate spar rotatably connected to the mounting spar at a first end of the second intermediate spar;

a seat bracket, the seat bracket rotatably connected to a second end of the first intermediate spar and a second end of the second intermediate spar;

a first torque link rotatably connected to the mounting spar at a first end of the first torque link, wherein the first torque link is rotatably connected to the seat bracket at a second end of the first torque link;

a second torque link rotatably connected to the mounting spar at a first end of the second torque link, wherein the second torque link is rotatably connected to the seat bracket at a second end of the second torque link;

a tension member disposed between the mounting spar and the first and second intermediate spars;

a sleeve surrounding the first intermediate spar, second intermediate spar, first torque link, second torque link, and tension member; and a seat, the seat affixed to the seat bracket.

5. The apparatus of claim 4, wherein the tension member comprises a hydraulic cylinder.

6. The apparatus of claim 4, wherein the tension member comprises an elastic band.

7. The apparatus of claim 4, further comprising a tether hook disposed on the mounting spar.

8. The apparatus of claim 4, further comprising a submerged safety indicator.

9. The apparatus of claim 8, wherein the submerged safety indicator comprises a pole affixed to the seat in a substantially perpendicular orientation to a seat top surface.

10. The apparatus of claim 9, further comprising a pennant affixed to one end of the pole.

* * * * *